US007350257B2

(12) United States Patent
McKay

(10) Patent No.: US 7,350,257 B2
(45) Date of Patent: Apr. 1, 2008

(54) CLEANING TOOL WITH REMOVABLE CLEANING SHEETS

(75) Inventor: William D. McKay, Grand Blanc, MI (US)

(73) Assignee: Rapid Brands Corporation, Grand Blanc, MI (US)

( * ) Notice: Subject to any disclaimer, the term of this patent is extended or adjusted under 35 U.S.C. 154(b) by 459 days.

(21) Appl. No.: 10/637,938

(22) Filed: Aug. 9, 2003

(65) Prior Publication Data

US 2004/0031119 A1 Feb. 19, 2004

Related U.S. Application Data

(63) Continuation-in-part of application No. 09/993,137, filed on Nov. 16, 2001, now Pat. No. 6,810,554, and a continuation-in-part of application No. 09/979,415, filed on Jun. 11, 1999, now abandoned, and a continuation-in-part of application No. 09/602,189, filed on Jun. 12, 2000, now Pat. No. 6,405,403, which is a continuation-in-part of application No. 09/094,551, filed on Jun. 12, 1998, now Pat. No. 6,298,517.

(60) Provisional application No. 60/311,463, filed on Aug. 11, 2001, provisional application No. 60/260,969, filed on Jan. 10, 2001, provisional application No. 60/436,031, filed on Dec. 23, 2002.

(51) Int. Cl.

| | |
|---|---|
| ***A47L 13/12*** | (2006.01) |
| ***A47L 13/20*** | (2006.01) |
| ***A47L 13/18*** | (2006.01) |

(52) U.S. Cl. ..... 15/118; 15/104.94; 15/227; 15/228

(58) Field of Classification Search ..... 15/118, 15/208, 209.1, 223, 228, 227, 104.94
See application file for complete search history.

(56) References Cited

U.S. PATENT DOCUMENTS

| | | | | |
|---|---|---|---|---|
| 0,466,337 A | | 1/1892 | Fries | 15/231 |
| 1,146,668 A | | 7/1915 | Tanaka | 15/228 |
| 1,587,670 A | | 6/1926 | Nebelung | 15/231 |
| 1,852,114 A | | 4/1932 | Green | 15/104.93 |
| 1,946,321 A | | 2/1934 | Hunter | 15/228 |
| 2,221,305 A | * | 11/1940 | Fielding | 15/247 |
| 2,226,654 A | * | 12/1940 | Bates | 15/231 |
| 2,301,505 A | | 11/1942 | Bates | 15/231 |
| 2,414,872 A | | 1/1947 | Harter | 15/231 |
| 2,465,194 A | | 3/1949 | Brouty | 15/231 |

(Continued)

FOREIGN PATENT DOCUMENTS

DE 31 27 860 A1 2/1983

(Continued)

*Primary Examiner*—Mark Spisich
(74) *Attorney, Agent, or Firm*—Gifford, Krass, Sprinkle, Anderson & Citkowski, P.C.

(57) ABSTRACT

A refill is designed for use with a cleaning tool, such as a mop or a cleaning mitt. The refill includes a mopping sheet, formed from a water absorbing material, and a dusting sheet. In one example, the dusting sheet is removed from the refill after dusting a surface to expose the mopping sheet. A single refill allows a surface to be dusted and then mopped using the same cleaning tool.

31 Claims, 23 Drawing Sheets

U.S. PATENT DOCUMENTS

| | | | | | |
|---|---|---|---|---|---|
| 2,648,863 | A | | 8/1953 | Darling | 15/231 |
| 2,655,680 | A | * | 10/1953 | Geerin | 15/228 |
| 2,693,610 | A | | 11/1954 | Hensley, Jr. | 15/104.002 |
| 2,702,913 | A | | 3/1955 | Walkama | 15/104.002 |
| 2,708,761 | A | | 5/1955 | Berquist | 15/104.002 |
| 2,739,334 | A | | 3/1956 | Hardey | 15/231 |
| 2,756,549 | A | | 7/1956 | Macullar | 451/491 |
| 2,870,475 | A | | 1/1959 | Scheuer et al. | 15/231 |
| 3,199,136 | A | | 8/1965 | George | 15/231 |
| 3,273,192 | A | | 9/1966 | Mazzella | 15/144.1 |
| 3,376,595 | A | | 4/1968 | Cole | 15/228 |
| 3,506,996 | A | | 4/1970 | Brennan | 15/144.1 |
| 3,613,146 | A | | 10/1971 | Oviatt | 15/231 |
| 3,742,547 | A | | 7/1973 | Sohmer | 15/104.002 |
| 4,114,223 | A | | 9/1978 | Buchanan | 15/228 |
| 4,817,229 | A | | 4/1989 | Sedillo | 15/144.1 |
| 4,937,910 | A | | 7/1990 | Frazier | 15/231 |
| 4,991,250 | A | | 2/1991 | Young | 15/228 |
| 5,012,542 | A | | 5/1991 | Lynn | 15/1 |
| 5,071,489 | A | | 12/1991 | Silvenis et al. | 15/231 |
| 5,094,559 | A | | 3/1992 | Rivera et al. | 401/132 |
| 5,435,852 | A | | 7/1995 | Robinson | 134/6 |
| 5,455,980 | A | | 10/1995 | Buchanan | 15/228 |
| 5,477,582 | A | | 12/1995 | Yamashita | 15/231 |
| 5,522,648 | A | | 6/1996 | Wilen | 300/21 |
| 5,525,397 | A | | 6/1996 | Shizuno et al. | 428/138 |
| 5,553,344 | A | | 9/1996 | Rosenkrantz | 15/104.002 |
| 5,596,787 | A | | 1/1997 | Stevens et al. | 15/228 |
| 5,603,138 | A | | 2/1997 | Bonis | 15/220.1 |
| 5,639,532 | A | | 6/1997 | Wells | 428/95 |
| 5,878,459 | A | | 3/1999 | McParland | 15/144.1 |
| 6,243,909 | B1 | * | 6/2001 | Graham et al. | 15/228 |

FOREIGN PATENT DOCUMENTS

| | | |
|---|---|---|
| GB | 2233882 | 1/1991 |

* cited by examiner

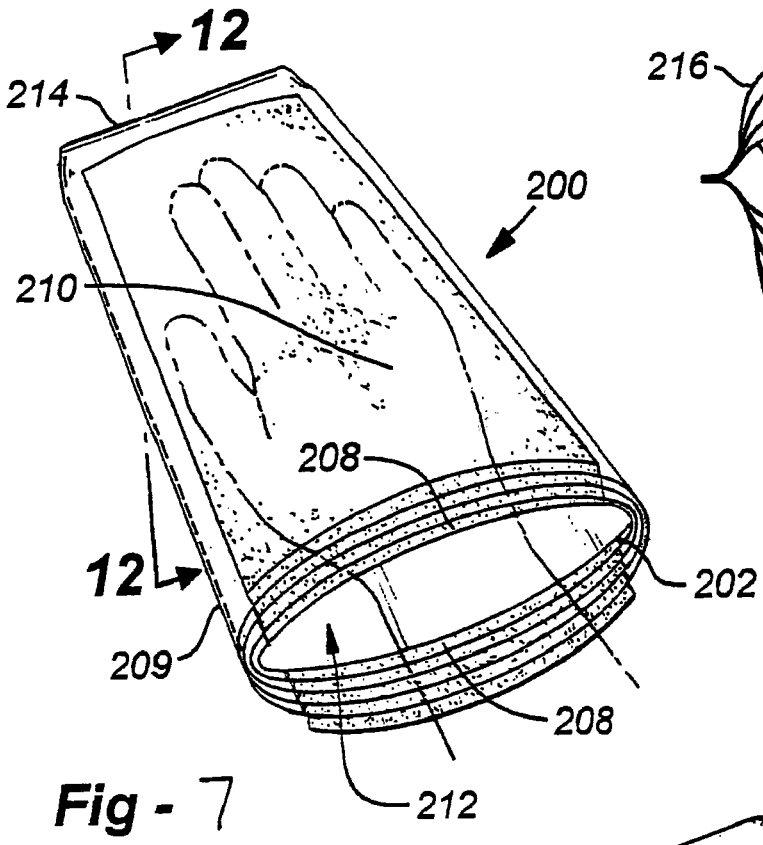
Fig - 7
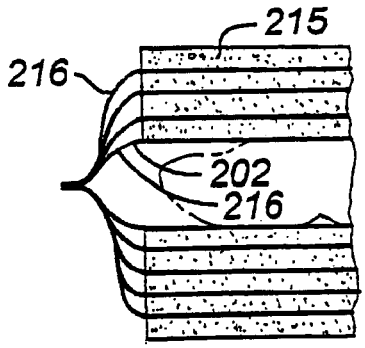
Fig - 8
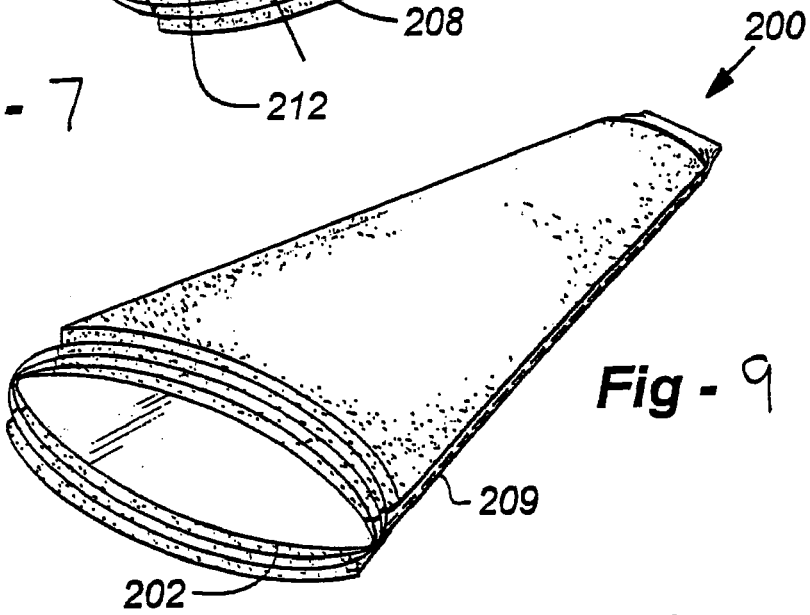
Fig - 9
Fig - 10
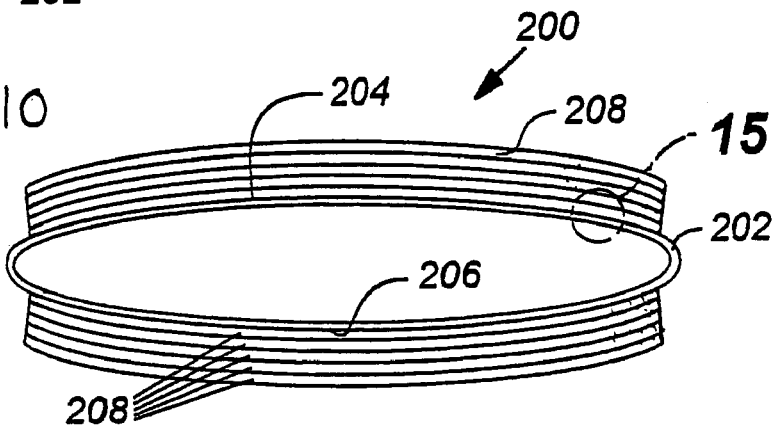

| |
|---|
| M pping Sheet |
| Pre-cleaning Sh t |
| Pre-cl aning Sh et |
| Dusting Sheet |

Figure 45

| |
|---|
| Premoistened Sheet |
| Premoistened Sheet |
| Premoistened Sheet |
| Premoistened Sheet |

Figure 46

| |
|---|
| Mopping Sheet |
| Mopping Sheet |
| Mopping Sheet |
| Mopping Sheet |

Figure 47

| |
|---|
| Mopping Sheet |
| Dusting Sheet |
| Mopping Sheet |
| Dusting Sheet |

Figure 48

CLEANING TOOL WITH REMOVABLE CLEANING SHEETS

REFERENCE TO RELATED APPLICATIONS

This application is a continuation-in-part of U.S. patent application Ser. No. 09/993,137, filed Nov. 16, 2001 now U.S. Pat. No. 6,810,554, which is a continuation-in-part of U.S. patent application Ser. No. 09/979,415, which is the U.S. national phase of PCT/US99/12945, filed Jun. 11, 1999, now abandoned. U.S. patent application Ser. No. 09/993,137 claims priority from U.S. Provisional Patent Application Ser. Nos. 60/311,463, filed Aug. 11, 2001 and 60/260,969, filed Jan. 10, 2001, and is also a continuation-in-part of U.S. patent application Ser. No. 09/602,189, filed Jun. 12, 2000, now U.S. Pat. No. 6,405,403, which is a continuation-in-part of U.S. patent application Ser. No. 09/094,551, filed Jun. 12, 1998, now U.S. Pat. No. 6,298,517. This application also claims priority from U.S. provisional patent application Ser. No. 60/436,031, filed Dec. 23, 2002.

FIELD OF THE INVENTION

This invention relates generally to cleaning sheets and tools for cleaning surfaces such as counters, mirrors, windows, floors, walls, ceilings, motor vehicles, shoes, pet coats, and furniture surfaces and, more specifically, to removable cleaning sheets for a cleaning tool.

BACKGROUND

Surfaces such as counters and floors are most aesthetically pleasing and safe when they are clean, dry, and free of dirt or debris. Unfortunately, surfaces typically become soiled rapidly due to environmental contaminants such as dust and due to the deposit of dirt and debris and liquids by people, machines, and pets. Numerous devices and methods have been developed for returning a surface to a clean and dry condition and people are constantly striving to develop better methods. Sweeping or vacuuming works well for removing loose dirt and debris, and mopping works well for removing liquids and certain debris which is lightly adhered to a surface such as a tile or wood floor. These methods work well to thoroughly clean a surface such as a floor but all suffer from the drawback of being time consuming and difficult.

Vacuuming a small area requires a person to locate the vacuum cleaner, uncoil and plug in a power cord, select the correct attachments, vacuum up the dirt and debris, and reverse the process to put the vacuum cleaner back away. Likewise, mopping a small area requires the use of a mop and bucket. Either approach is time consuming.

Mopping a surface which is covered with dust may smear the dust over the surface, making the surface appear even dirtier. However, it is highly inconvenient to find a dusting cloth or vacuum, dust the surface, then find a separate mop and finally mop the surface. Therefore, there is a need for a simple device to quickly and easily clean a variety of surfaces, for example by allowing dusting and mopping to be achieved using the same mop refill.

SUMMARY OF THE INVENTION

The present invention provides a refill for a mop of the type having a mop head with a lower surface and an opposed upper surface interconnected by a leading and a trailing edge. The mop head has gripping means provided on the upper surface for retaining a cleaning sheet on the mop head. The refill includes a mopping sheet having an absorbent layer and an outer cleaning layer, and a dusting sheet releasably attached to the mopping sheet.

In other embodiments, a refill includes a base layer with a front edge and an opposed rear edge with a midportion therebetween. The base layer is configured to be wrapped about the mop head with the midportion adjacent to the lower surface of the mop head and the front and rear edges wrapping onto the upper surface of the mop head so as to be retained by the gripping means. A plurality of cleaning sheets are removably supported on the midportion of the base layer in a stack configuration. Each of the sheets has an outward face for cleaning and an opposed inward face. The outward face of each of the sheets is configured to contact the surface to be cleaned and thereby become soiled. When the outward face of the outermost sheet becomes soiled, the sheet may be peeled away to expose a non-soiled sheet. Stacked sheets may include mopping and dusting sheets in an alternating fashion.

In other embodiments of the present invention, the cleaning sheets are formed from a non-woven material, and in other embodiments a cleaning layer, which may be a non-woven material, and a backing layer, are both provided for each of the cleaning sheets. In other embodiments, a cleaning sheet includes a dusting sheet, a mopping sheet, a water absorbent layer, and a backing sheet. The sheets may be coextensive and joined at their edges so that the joined edges may be gripped by the gripping means on the upper side of the mop.

The present invention also provides a cleaning mitt having a plurality of coextensive and mitt-shaped cleaning sheets disposed in a stacked configuration. Each cleaning sheet has a central portion bounded by an outer perimeter, with the outer perimeter having a first edge. The perimeters of the cleaning sheets are bonded to each other, except along the first edge, such that the plurality of cleaning sheets are retained in the stacked configuration. The first edge defines an opening such that a hand may be passed between adjacent cleaning sheets to a position between the central portions of the adjacent cleaning sheets. A portion of each of the cleaning sheets is separable from the stack of cleaning sheets such that when an outermost sheet becomes soiled, the separable portion of the cleaning sheets may be peeled away to expose a portion of the non-soiled sheet. In other embodiments, a dusting sheet can be peeled away to reveal a mopping sheet, allowing a person to dust a dry surface, then further clean the surface using a mopping sheet.

BRIEF DESCRIPTION OF THE DRAWINGS

FIG. 7 is a perspective view of a cleaning tool according to a further embodiment of the present invention wherein a core of the cleaning tool is sized to accept a hand;

FIG. 8 is a cross-sectional view of the cleaning tool of FIG. 7 taken along lines 12-12;

FIG. 9 is an additional perspective view of the cleaning tool of FIG. 7 showing perforations along an edge thereof;

FIG. 10 is an end view of the cleaning tool of FIGS. 7-13 showing the opening for insertion of a hand;

FIGS. 40-51 illustrate in end view various combinations of cleaning sheets;

DETAILED DESCRIPTION OF THE PREFERRED EMBODIMENTS

Figure 1:
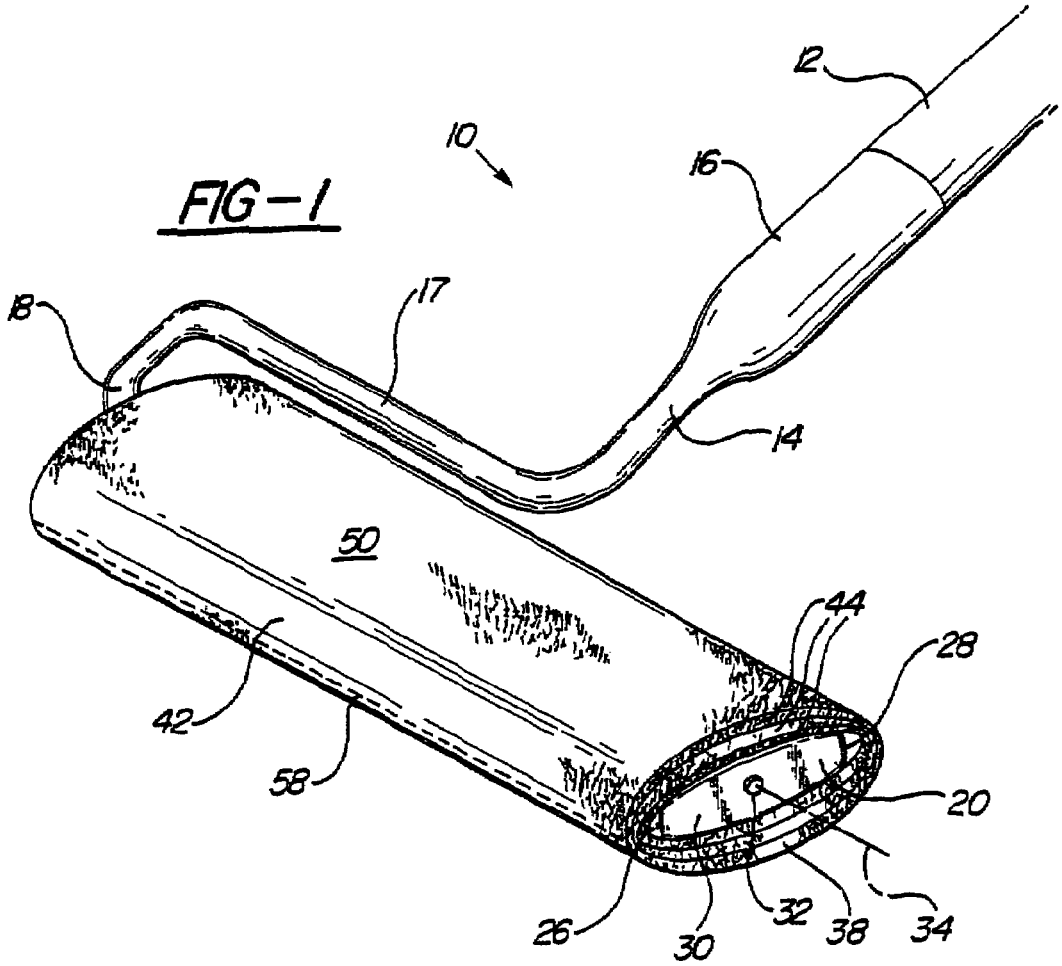
FIG. 1 is a perspective view of one embodiment a mop according to the present invention.
Figure 2:
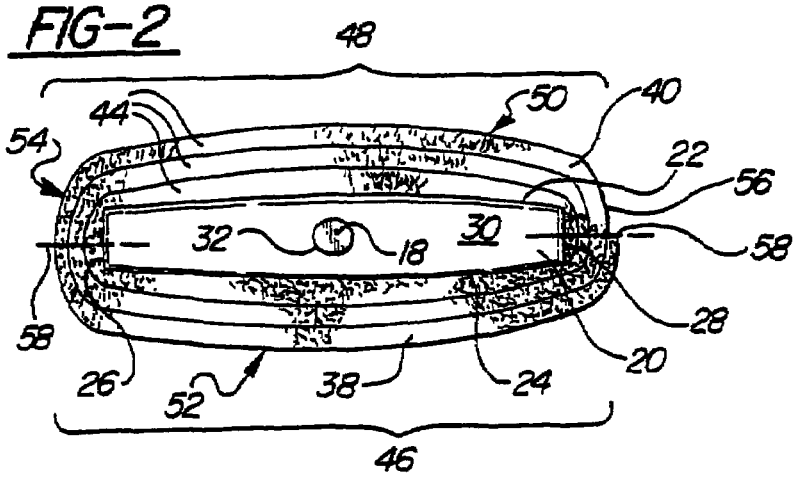
FIG. 2 is an end view of the mop of FIG. 1.

Referring to FIGS. 1 and 2, a mop according to the present invention is generally shown at 10. The mop 10 includes an elongated handle 12 for a user to grip the mop 10 and a mop head 20 which is interconnected with the mop handle 12 by a mop head mount 14. The elongated handle 12 is detachable from the mount 14. Other sizes and shapes of handles may be substituted, such as an extension pole to allow use of the mop to clean a surface that is hard to reach. The mop 10 can also be used without the elongated handle 12, with the user gripping the mop head mount 14 which acts as a short handle.

The mop head 20 has a top side which is defined as an upper surface 22, and a bottom side which is defined as a lower surface 24. The upper and lower surfaces 22, 24 are interconnected at the front of the mop head 20 by a leading edge 26 and at the back of the mop head by a trailing edge 28. The sides of the mop head are defined by a pair of ends 30.

An elongated web 38 of cleaning material 40 is wrapped about the mop head 20 so as to form an oblate roll 42 with a plurality of layers 44. The roll 42 of material 40 defines a first plurality of cleaning sheets 46 supported on the lower surface 24 of the mop head 20 and a second plurality of cleaning sheets 48 supported on the upper surface 22 of the mop head 20. The cleaning sheets 46, 48 are each removably supported on the respective surfaces 22, 24 in stacked configurations. The cleaning sheets 46, 48 are defined by a web 38 of cleaning material 40 wrapped about the mop head 20, the cleaning sheets 46, 48 may also be individual sheets which are supported on one or both surfaces 22, 24 of the mop head 20 in a stacked configuration.

For clarity of description, the roll 42 is defined as having an upper surface 50 on the top of the roll 42, a lower surface 52 on the bottom of the roll 42, a leading edge 54 interconnecting the upper 50 and lower 52 surfaces at the front of the roll 42, and a trailing edge 56 interconnecting the upper 50 and lower 52 surfaces at the rear of the roll 42. The upper 50 and lower 52 surfaces and the leading 54 and trailing 56 edges correspond to the like named portions of the mop head 20. The upper 50 and lower 52 surfaces of the roll 42 are preferably curved.

In the illustrated embodiment, the web 38 of material 40 includes perforations 58 to allow a portion of the web 38 of material 40 to be removed from the remainder of the web 38. Perforations 58 are located on the leading 54 and trailing 56 edges of the roll 42 so that a portion of the web 38 forming the upper 50 or lower 52 surface may be removed in its entirety, thereby exposing a fresh surface. The perforations 58 may either be cut after the roll 42 is formed or the material 40 may be perforated prior to forming the roll 42. By "perforations," it is meant that the web has areas designed to tear or separate. This includes the use of a weakened area, a series of small cuts, or one or more large slits.

The roll 42 of cleaning material 40 is preferably configured so as to allow the use of refills. Roll 42 is formed such that it may be removed from the mop head 20 and replaced with a new roll 42. The roll 42 may be formed with some type of core, such as a cardboard tube, or as a coreless roll. Either way, the roll 42 is configured to be placed over mop head 20. Once the roll 42 of cleaning material 40 is used up, a new roll 42 can be placed on the mop head 20.

The cleaning material 40 or individual cleaning sheets have an outward face 60 for cleaning and an opposed inward face 62. In using the mop 10 of the illustrated embodiment, the mop 10 is oriented such that the lower surface 52 of the mop head 20 faces a surface to be cleaned, such as a floor. The outward face 60 of the lower surface 52 of the roll 42 is brought in contact with the floor, thereby becoming soiled. When the used portion of the roll 42 becomes sufficiently soiled as to require replacement, that portion of the roll 42 is removed by peeling off the material 40 and tearing along a perforation 58. Thereby, an unsoiled portion of the material is exposed for cleaning. If using the embodiment with a plurality of individual sheets 46, 48 not in a roll 42, the outermost sheet may be peeled off once it becomes soiled.

The cleaning material may present a dusting sheet removably attached to a mopping sheet. For example, a roll of cleaning material may be wrapped around a mop head so as to present a dusting sheet at the lower dusting surface. After dusting the surface, the dusting sheet can be removed to expose a mopping sheet. After mopping the surface with the mopping sheet, the mopping sheet, and a backing sheet if provided, can be torn off and the roll rotated so as to present another dusting sheet.

The illustrated mop head 20 is an elongated piece of material such as plastic or metal. In plan view, the mop head 20 is generally rectangular with a side-to-side width (the distance between the ends 30) greater than its front-to-back length (the distance between the leading edge 26 and trailing edge 28). In one preferred embodiment, a mop head 20 has a side-to-side width of approximately 13 inches and a front-to-back length of approximately four inches, though other sizes and shapes are certainly possible.

Referring to FIG. 2, the mop head 20 is generally rectangular in cross-section with a thickness (the distance between the upper surface 22 and the lower surface 24) less than its front-to-back length. In one preferred embodiment, the mop head 20 has a thickness of approximately one inch. As shown, the upper 22 and lower 24 surfaces are preferably slightly convexly curved in cross-section, but alternatively may be flat or greatly curved.

The mop head 20 has an axial bore 32 which passes widthwise through the mop head 20, passing through both ends 30. The axial bore 32 defines a support axis 34 for the mop head 20. The mop head mount 14 is generally hook shaped and has a handle mounting portion 16 at one of its ends, and a perpendicular support portion 18 at its other end. The mounting portion 16 and support portion 18 are interconnected by an interconnection portion 17 that meets the support portion 18 at right angles and curves up to meet the mounting portion 16. The support portion 18 is disposed in the axial bore 32 of the mop head 20, thereby interconnecting the mop head 20 with the mop handle 12. As will be clear to one of skill in the art, a mop head mount 14 of this type is similar to the mounting arrangement used with paint rollers and the like and may be implemented in a number of ways.

Preferably, the mop head 20 is pivotally interconnected with the mop handle 12 by the mop head mount 14. In the illustrated embodiment, the support portion 18 of the mop head mount 14 is rotatable within the axial bore 32 of the mop head 20 thereby allowing the mop head 20 to pivot about the support axis 34 of the mop head. As illustrated, the lower surface 24 of the mop head 20 is positioned on the bottom side of the mop head 20 so as to face a horizontal surface to be cleaned, such as a floor. Because the mop head 20 and the mop handle 12 are pivotally interconnected, the mop head 20 can be rotated 180 degrees relative to the mop handle 12 thereby repositioning the lower surface 24 on the top side of the mop head 20 and the upper surface 22 on the bottom side of the mop head 20. By rotating the mop head 20, both the upper 22 and lower 24 surfaces of the roll 42 of material 40 can be used to clean and will become soiled.

In another embodiment, a mop head may comprise a pair of end supports which interconnects each end of a roll of cleaning material, thereby supporting the roll. In this case, the mop head supports the roll at its ends.

Other alternative mop head designs also fall within the present invention. As discussed previously, a first plurality of cleaning sheets may be supported in a stacked configuration on only one surface of a mop head. This simpler embodiment of the mop head may be of a variety of shapes as long as it provides a surface for supporting a stack of cleaning sheets. Alternatively, a plurality of cleaning sheets may be stacked on more than one surface of the mop head. For example, with a rectangular cross section mop head, a first and a second plurality of cleaning sheets may be separately supported on the upper and lower surfaces of the mop head. This differs from the earlier discussed embodiment in that the first and second plurality of cleaning sheets are each individual stacks rather than being formed as part of a roll. As another example, the mop head may be triangular in cross section, having three surfaces, an upper surface, a lower surface, and a third surface. Individual stacks of cleaning sheets may be supported on one or more of these surfaces.

The web 38 of cleaning material 40 is wrapped about the mop head 20 so as to form an oblate roll 42. As used herein, "oblate roll" refers to a variety of shapes wherein the distance between the upper 22 and lower 24 surfaces of the roll 42 is less than the distance between the leading edge 54 and trailing edge 56 of the roll. The oblate roll 42 may be ellipsoidal, oval, or football-shaped in cross-section so as to present a curved upper 22 and lower 24 surfaces. Alternatively, the oblate roll 42 may also be a roll that has a flat upper 22 and lower surface 24. However, it is preferred that the upper 22 and lower 24 surfaces are curved. The oblate shape of the roll 42 is important to the function of the mop 10. Because the roll 42 is not round, the oblate roll 42 resists rolling across a surface to be cleaned as the contact is moved across the surface. Instead, the lower surface 24 of the roll 42 tends to remain in contact with the surface to be cleaned as the mop head 20 is moved across the surface. The mop head 20 will rotate slightly as it is moved back and forth across the surface to be cleaned but resists clipping to expose the upper surface 22 due to the flattened shape of the oblate roll 42.

The web 38 of cleaning material 40 which forms the oblate roll 42 may be of several types depending upon the application of the mop 10. In FIGS. 1 and 2, the cleaning material 40 disposed on the mop head 20 is a single layer of bibulous material such as a non-woven material or a paper towel-like material. Sponge-like and woven materials are also possible. By "bibulous" it is meant that the cleaning material 40 is absorbent and is capable of being imbibed with a cleaning solution. In the simplest embodiment, the cleaning material 40 is a paper towel-like material which can be used to absorb small spills. The material 40 can also be sprayed with a cleaning solution and then brought into contact with a soiled region for cleaning the soiled region. Alternatively, the cleaning material 40 is a non-woven material that is pretreated with a substance such as mineral oil or lemon oil. The cleaning material 40 may also be pretreated with other substances such as a disinfectant. The oil treated embodiment is especially useful for picking up dust such as from a hardwood floor. The mineral oil or lemon oil allows the mop 10 to pick up and retain dust as it comes into contact with the cleaning material 40. This provides an especially easy and quick way to make a hardwood floor appear freshly cleaned. The cleaning material 40 may be embossed or multi-dimensional to give the outward surface texture so as to improve the cleaning ability of the cleaning material 40.

The layers 44 of the cleaning material 40 forming the oblate roll 42 may be retained in their stacked configuration in a variety of ways. Many non-woven and paper towel-like materials actually cling to themselves and therefore the outermost layer would tend to stay in place on the roll 42 until manually removed by the user. Alternatively, and preferably, the inward face 62 of each of the layers 44 of cleaning material 40 is treated with an adhesive 64 for retaining the layers 44 in place. This causes the inward face 62 of one layer 44 to stick to the outward face 60 of an adjacent layer 44. As will be clear to one of skill in the art, the adhesive 64 is chosen and applied so as to allow easy releasability of a soiled portion of the cleaning material 40 from the remainder of the roll 42. Adhesive may be applied to the inward face 62 of the cleaning material 40 in a pattern or the adhesive 64 may be flood coated on the inward face 62 of the cleaning material 40. Alternatively, only a portion of the inward face 62 may be adhesive coated. For example, it may be desirable to leave one or more of the edges of the material 40 uncoated to make removal easier.

Figure 3:
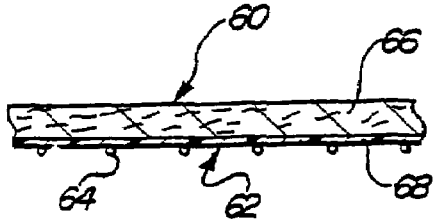
FIG. 3 is a cross-sectional view a portion of one embodiment of a cleaning sheet for use with a mop according to the present invention.

Referring now to FIG. 3, a portion of a preferred embodiment of the cleaning material 40 is shown in cross section. In this embodiment, the cleaning material 40 includes a bibulous layer 66, such as a non-woven or paper towel-like material, that defines the outward face 60 of the cleaning material 40. The bibulous layer 66 may also be a thin sponge-like material or a woven material. The cleaning material 40 also has a moisture barrier layer 68 that is operative to prevent transport of liquid from the bibulous layer 66 of one sheet 46, 48 to the bibulous layer 66 of an adjacent sheet 46, 48 when the sheets are in a stacked configuration. Preferably, the moisture barrier layer 68 also supports and strengthens the bibulous layer 66. The moisture barrier layer 68 defines the inward face 62 of the cleaning material 40 and is preferably pattern coated with adhesive 64 for retaining one layer 44 of cleaning material 40 in place on an adjacent layer 44 of cleaning material 40. The moisture barrier layer 68 may be any of a variety of thin plastic materials or may be formed of other material which prevents the transport of moisture therethrough. The moisture barrier layer 68 may also be formed by coating the bibulous layer 66 with a moisture barrier substance. Adhesive 64 may be either pattern coated or flood coated on the inward face 62 of the moisture barrier layer 68. Alternatively, where the moisture barrier layer 68 is a coating on the bibulous layer 66, the moisture barrier layer 68 may be naturally tacky, thereby eliminating the need for additional adhesive 64. As another alternative, the cleaning material 40 may be a single layer material with inherent moisture barrier or moisture resistant characteristics.

The use of a multiple layer cleaning material 40, as shown in FIG. 3, allows for a variety of combinations of materials and treatments to suit a variety of applications. For the simplest arrangement, the bibulous layer 66 is simply an absorbent sheet which can be used for light cleaning duties such as soaking up spills. The moisture barrier layer 66 prevents the spill from wetting more than the outermost layer of the cleaning material 40. Once the bibulous layer 66 is soiled, or has absorbed its capacity of liquid, the user may peel the outermost layer of the cleaning material 40 from the remainder of the roll 42 thereby exposing a new bibulous layer 66. The mop head 20 may also be rotated to expose the upper surface 50 of the roll 42 for further cleaning. Alternatively, the bibulous layer 66 may be pretreated with a liquid such as dusting oils or cleaning solutions. Because the bibulous layer 66 is sandwiched between adjacent moisture barrier layers 68, the dusting oil or cleaning solution is prevented from evaporating from all but the outermost layer of the roll. Therefore, when a user is ready to use the mop, the user first peels off the outermost layer to expose a fresh bibulous layer 66 that is pretreated with a dusting oil or cleaning solution. Alternatively, the mop 10 is provided with a cover configured to cover and moisture seal the mop head 20 when it is not in use. The cover prevents evaporation from the outermost layer of the roll 42 so that the mop 10 remains ready to use.

In other embodiments, a multi-layer cleaning material may comprise a continuous roll including a number mopping sheets, possibly having a moisture barrier layer as shown in FIG. 3. Each mopping sheet can be separated from its neighbor using a perforation or other structural weakness. Each mopping sheet can support a removable dusting sheet, allowing a surface to be dusted, the dusting sheet to be removed, and the surface then mopped using an area of the mopping sheet exposed by removal of the dusting sheet.

Figure 4:
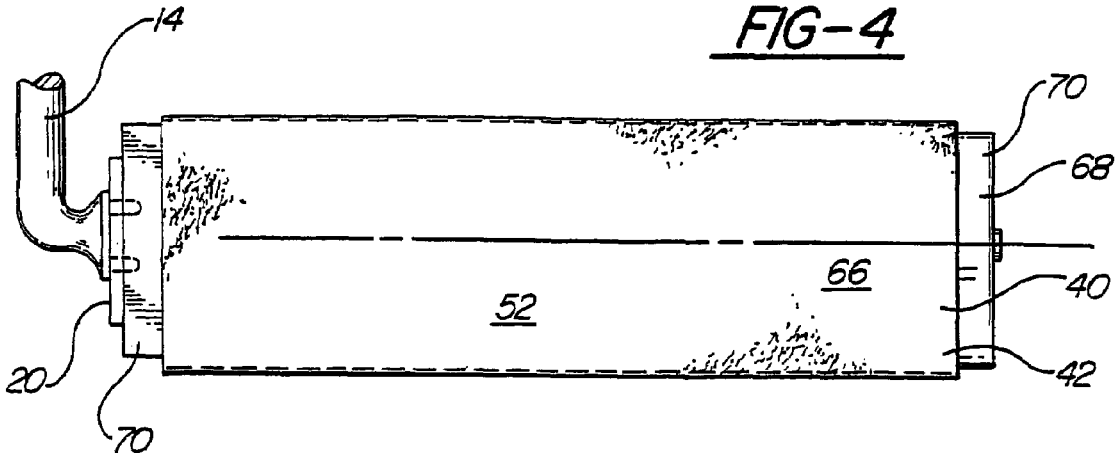
FIG. 4 is a bottom view of a second embodiment of a mop according to the present invention.

Referring now to FIG. 4, a second embodiment of a mop 10 according to the present invention is shown. This embodiment differs from the embodiment of FIG. 1 in that the cleaning material 40 consists of two layers, a bibulous layer 66 and a moisture barrier layer 68, as in FIG. 3. As shown, the moisture barrier layer 68 is wider than the bibulous layer 66 leaving a projecting portion 70 which projects beyond each side of the bibulous layer 66 adjacent the ends 30 of the mop head 20. These projecting portions 70 serve a couple of purposes. First, the projecting portions 70 do not become soiled during the cleaning process because they are not absorbent or treated with cleaning solution. Therefore, the projecting portions 70 provide a non-soiled area which a user can grip to help remove the outermost layer from a roll 42 of cleaning material 40. Secondly, the inward face 62 of the moisture barrier layer 68 is treated with an adhesive causing the projecting portions 70 to stick to the adjacent projecting portions 70 in the adjacent layers 44 of the roll 42. The projecting portions could also be interconnected by heat bonding, sonic welding, or mechanical bonding. This further seals in the unsoiled bibulous layers 66 to prevent their premature contamination. The projecting portions 70 prevent liquid and dirt from contaminating the ends of the unexposed bibulous layers 66 by sealing off those ends. Preferably, this allows the roll 42 of cleaning material 40 to be held under a faucet or dipped in a bucket thereby wetting the outermost bibulous layer 66 without wetting the unexposed layers. Alternatively, the moisture barrier layer 68 does not project beyond the bibulous layer 66 or projects only at one side.

Figure 5:
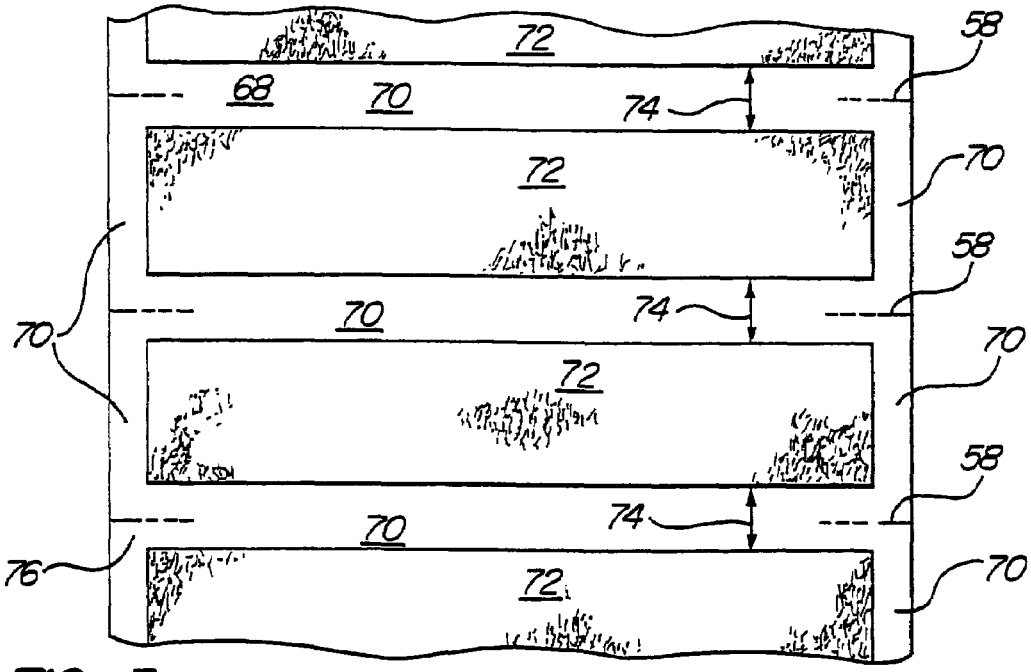
FIG. 5 is a plan view of a portion of one embodiment of a web of cleaning material for use with a mop according to the present invention.
Figure 6:
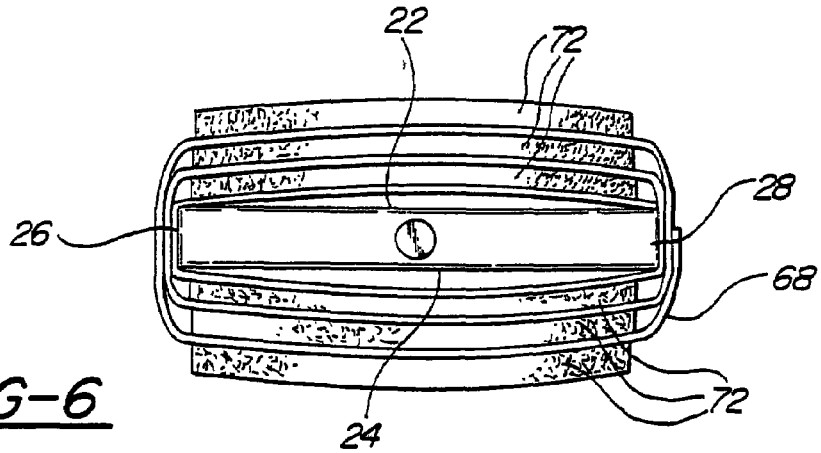
FIG. 6 is an end view of a mop head with a web of cleaning material as shown in FIG. 5 wrapped about the mop head.

Referring now to FIGS. 5 and 6, another alternative embodiment of the cleaning material 40 is shown. In this embodiment, the web 38 of cleaning material 40 includes a web 38 of moisture barrier material 68 that acts as both a support layer and a moisture barrier layer. A plurality of bibulous cleaning pads 72 are supported on the support layer along its length leaving a gap 74 between each cleaning pad 72. Therefore, the support layer forms a continuous web 38 with the bibulous pads 72 placed at intervals along the support layer. As shown in FIG. 6, the web 38 of cleaning materials 40 is then wrapped about the mop head 20 so as to position the bibulous pads 72 on the upper 22 and lower 24 surfaces of the mop head 20. The gaps 74 between the pads 72 are positioned adjacent the leading 26 trailing 28 edges of the mop head 20. As will be clear to one of skill in the art, the gaps 74 between the bibulous pads 72 preferably vary in dimension so as to allow the bibulous pads 72 to remain in a stacked configuration when the web 38 of cleaning material 40 is wrapped about the mop head 20. The outer layers of the oblate roll 42 must have larger gaps 74 or larger bibulous pads 72 so that the bibulous pads 72 continue to be aligned as the roll 42 is formed. Preferably, the support layer is perforated in each of the gaps 74 so as to allow removal of a portion of the support layer including one bibulous pad 72 from the roll 42 of cleaning material 40.

As can be seen, this configuration of the cleaning material 40 creates a projecting portion 70 that extends around the entire perimeter of each bibulous pad 72, thereby forming a perimeter margin 76. Therefore, the support/moisture barrier layer 68 extends not only beyond each bibulous pad 72 adjacent the ends 30 of the mop head 20, but also beyond each bibulous pad 72 adjacent the leading 26 and trailing 28 edges of the mop head 20. By adhesive coating the inward face 62 of the support/moisture barrier layer 68, each perimeter margin 76 can be bonded to an adjacent perimeter margin 76 thereby totally encapsulating each unexposed bibulous pad 72. Preferably, this allows the mop head 20, including the roll 42 of cleaning material 40, to be submerged in a bucket of cleaning solution, with only the outermost bibulous pads 72 being exposed to the cleaning solution.

In one example, a roll of material may support alternating pads, corresponding to mopping sheets and dusting sheets. With reference to FIG. 5, an alternative embodiment provides pads or sheets 72 which alternate along the sheet between dusting sheets and mopping sheets.

Like the configuration in FIG. 4, the configuration of FIG. 6 provides clean portions of the cleaning material 40 for a user to grip when removing an outermost soiled layer. The configuration in FIG. 6 is especially advantageous in that a portion of the cleaning material 40 adjacent each perforation 58 does not become soiled in the cleaning process, making removal a more pleasant task.

In another embodiment, some or all of the outward face 60 of the perimeter margins 76 may be coated with a light adhesive so that dirt and debris tends to stick to the perimeter margin 76. This allows the perimeter margin to pick up dirt and debris which is pushed ahead of or pulled behind the bibulous pad 72 during the cleaning process thereby retaining the dirt or debris.

In alternative embodiments, the bibulous pads 72 may be positioned and/or sized such that they are flush with one or both sides of the moisture barrier layer 68, thereby eliminating all or part of the projecting portion 70. Also, a gap 74 is not required between each pad 72. Two pads 72 may be flush to one another followed with a gap 74 and then two more flush pads 72. Or, all pads 72 may be flush with no gaps 74. In these configurations, perforations may be placed after each pad 72, only in the gaps 74, or only between flush pads 72.

The bibulous pads 72 or the bibulous layers 66 of the above-discussed embodiments may be pretreated with a variety of substances. This includes dusting oils and cleaning solutions. As one example, pads 72 or the layer 66 may be pretreated with a dry antibacterial substance which becomes activated when the pad 72 or layer 66 is wetted. All pads 72 or the entire bibulous layer 66 may be treated with one substance such as the dusting oil or cleaning solution. Alternatively, different portions of the bibulous layer 66 or different bibulous pads 72 may be treated with different substances. As one alternative, the embodiment of the mop 10 having bibulous pads 72 separated by gaps 74 may have pads 72 treated with one substance alternate with pads 72 treated with a second substance. The first substance may be a solvent while the second substance may be a neutralizer. The pads located on the upper surface point to the mop head 20 would be treated with the first substance while the pads 72 located on the lower surface 24 of the mop head 20 would be treated with the second substance. Therefore, the user would first use the pads 72 located on one of the surfaces to apply the first substance, and then would rotate the mop head 20 180 degrees to use the pads 72 located on the other surface. As another example, the pads 72 located on the lower surface of the mop head 20 may be treated with a cleaning solution while the pads 72 located on the upper surface 22 of the mop head is not pretreated and therefore merely absorbent. The user would use the pads 72 located on the lower surface 24 to apply cleaning solution to the surface to be cleaned and would then rotate the mop head 20 and use the pad 72 located on the upper surface 24 to absorb the cleaning solution from the surface to be cleaned. Many other variations on this approach fall within the present invention.

In alternative embodiments, the bibulous pads 72 extend across the entire upper 22 or lower 24 surface and wrap up onto both the leading 26 and trailing 28 edge of the mop head 20 thereby leaving only a small gap 74 between each bibulous pad 72. This embodiment increases the usable amount of cleaning material 40 and also takes advantage of the natural curvature of the outer surface of the roll 42.

In an alternative embodiment, a mop refill can allow one surface of a mop head to present a dusting sheet, and another surface of a mop head to present a mopping sheet. The mop head may be rotated to change between mopping and dusting. With reference to FIG. 6, an alternative embodiment provides a plurality of dusting sheets, for example, stacked above the mop head, and a plurality of mopping sheets stacked below the mop head. After mopping with a first mopping sheet, the first mopping sheet can be removed so as to present a clean second mopping sheet. Alternatively, the stack of cleaning sheets can alternate between mopping sheets and dusting sheets.

The cleaning material configured for use with a mop according to the present invention has utility beyond the illustrated mops. For example, cleaning material 40 as illustrated in FIG. 3 can be torn from a roll 42 of such material 40 and used by hand to clean up a spill or other mess. A user may keep a refill roll handy for this purpose. Such material 40 can be especially useful when cleaning up objectionable messes that the user does not wish to contact with their hand. The moisture barrier layer 68 prevents waste contacting the bibulous layer 66 from being transported through to the user's hand. In addition, the adhesive 64 disposed on the moisture barrier layer 68 can be used to stick the cleaning material 40 to a user's hand for small cleanup jobs. A piece of material 40 can be stuck to the user's hand and formed around fingers and thumb and used to clean objects such as individual slats of vertical blinds and fan blades on ceiling fans. The user merely needs to wipe the object to be cleaned instead of wiping it with their bare hand. There is no need to grip the cleaning sheet; instead, the cleaning sheet hangs onto the user's hand.

The adhesive can also advantageously be used to stick portions of a cleaning sheet to itself. For example, if a person picks up an objectionable piece of waste with the bibulous layer of the cleaning material, the person can then crumple the piece of cleaning material around the piece of objectionable waste causing the adhesive on portions of the moisture barrier layer to contact other portions of the cleaning material causing the entire crumpled sheet to remain crumpled. This is similar to the effect created when crumpling up a piece of adhesive tape; a compact and secure ball can be formed. The adhesive side of the sheet can also be used to pick up crumbs, pet hair, and other debris. Like considerations apply with cleaning material that does not include the moisture barrier layer. The individual cleaning sheets or portions of the roll of cleaning material can be used to clean objects and surfaces without the use of a mop.

Mitts

This section describes cleaning tools which may accommodate a human hand; such cleaning tools also referred to herein as cleaning mitts. The term mitt-shaped refers to an approximate shape of a human hand, and a mitt-shaped cleaning tool may or may not include a thumb portion.

Referring now to FIGS. 7-10, a cleaning mitt 200 according to a further embodiment of the present invention is illustrated in several views. This embodiment can be used to clean hard surfaces such as floors, and also furniture, pets, and other surfaces. Specifically, the cleaning mitt is designed to be used by hand rather than by using an elongated handle, as with the earlier embodiments of the mop. This cleaning mitt 200 is well suited to cleaning countertops, mirrors, walls, as well as the coat of a pet or the skin of a person. In this embodiment, a central core 202 takes the place of the mop head in the prior embodiments. That is, the core 202 defines the center of the cleaning mitt 200. The core 202 may be made from many materials including paper, plastic or plastic film, or a variety of fabrics. The core 202 has an upper surface 204 and lower surface 206, as best shown in FIG. 10. A plurality of cleaning sheets 208 is supported on the lower surface 206 in a stacked configuration. A second plurality of cleaning sheets 208 is supported on the upper surface 204 also in a stacked configuration.

As best shown in FIG. 7, the cleaning mitt 200 is preferably designed so as to accommodate a human hand 210. Specifically, the core 202 has an opening 212 at one end and is closed at its other end 214. The core 202 is preferably tapered from the open end 212 down to the closed end 214. The hand 210 may be slid into the opening 212 so that the hand 210 is positioned inside the core 202. Then, the core may be positioned such that the lower surface is directed towards a surface to be cleaned, thereby bringing the outermost cleaning sheet 208 into contact with the surface to be cleaned. The surface may then be wiped to clean the surface thereby causing the outermost sheet 208 to become soiled. As with the prior embodiments, the soiled outermost sheet may be removed from the remaining stack to expose a new unsoiled sheet.

In plan view, the cleaning mitt is generally rectangular with an end-to-end width (the distance between the ends 212 and 214) greater than its front-to-back length (the distance between the leading edge and trailing edge). In one preferred embodiment, the mitt has an end-to-end width of approximately 9 inches and a front-to-back length of approximately 7 inches, though other sizes and shapes are certainly possible.

The mitt is generally rectangular in cross-section with a thickness (the distance between the upper surface and the lower surface) less than its front-to-back length. In one preferred embodiment, the mitt has a thickness of approximately one inch. As shown, the upper and lower surfaces are preferably slightly convexly curved in cross-section, but alternatively may be flat or greatly curved. Like the mop embodiment, some embodiments of the cleaning mitt may be considered an oblate roll.

The cleaning mitt of this embodiment may be constructed in any of the ways discussed as with the mop. That is, a single stack of cleaning sheets may be positioned on only one face of the core. More preferably, a continuous roll of cleaning sheets may be wrapped about the core so as to define a stack of cleaning sheets on both the top and bottom. This is illustrated in FIGS. 7-10.

In other embodiments, a mitt may be present a stack of dusting sheets on one face, and a stack of mopping sheets on the other. The mitt may be rotated on a hand to present dusting or mopping sheets, or switched from one hand to another. In other embodiments, the mitt may support a stack of alternating mopping and dusting sheets, so as to allow a person to dust a surface, remove, or pull back the dusting sheet to expose a mopping sheet, and then mop the surface. Moisture barrier sheets may also be used to keep a mopping sheet premoistened or to keep a dusting sheet dry. With reference to the other examples of cleaning mitts discussed, the bibulous layer may be a water-absorbing mopping sheet. The mopping sheet may support one or more removable dusting sheets.

Figure 11:
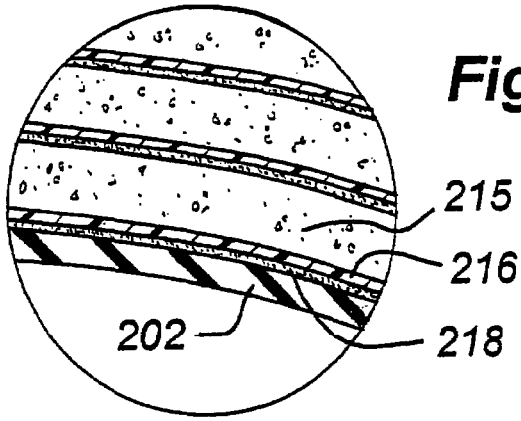
FIG. 11 is a detailed blow up view of a portion of the cleaning tool of FIG. 10, the magnified portion being indicated by circle 15 in FIG. 10.

As shown in FIG. 11, the cleaning sheets each consist of a bibulous layer 215 which overlies a moisture barrier layer 216. The moisture barrier layer 216 may be coated with an adhesive 218 to adhere the adjoining layers to one another.

As with the prior embodiments, the cleaning sheets may be constructed in other ways. As shown in FIGS. 7 and 8, the moisture barrier layers 216 may extend beyond the edges of the bibulous layer 215 so as to define a perimeter. The perimeters of the various layers may be adhered to one another by a releasable adhesive or bonding so as to seal each bibulous layer between adjacent moisture barrier layers. This would allow the cleaning mitt or mitt 200 to be dipped into water causing only the outermost bibulous layer to be wetted. Also, the perimeter may have an adhesive coating to allow it to pick up debris. As shown in FIG. 10, the moisture barrier layers 216 may extend only to the edges of the bibulous layers 215 and not extend into the perimeter area. As a further alternative, the innermost moisture barrier layer 216 may form the core 202, as illustrated in FIG. 8. Also, the core 202 may be rigid or flexible.

Figure 12:
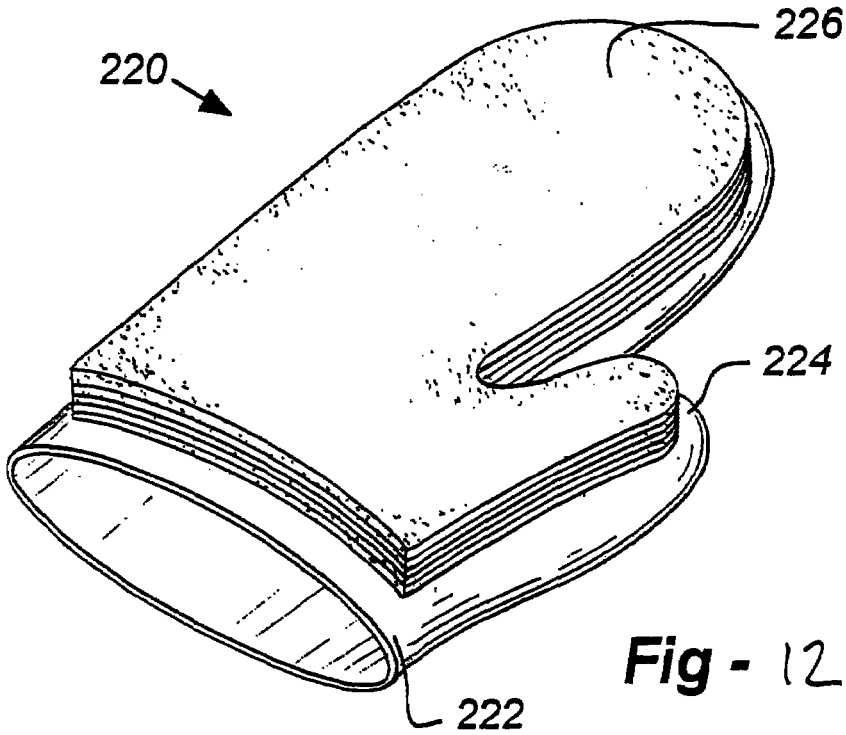
FIG. 12 is a perspective view of a cleaning tool according to a further embodiment of the present invention wherein the core of the cleaning tool is mitt shaped, having a thumb portion.
Figure 13:
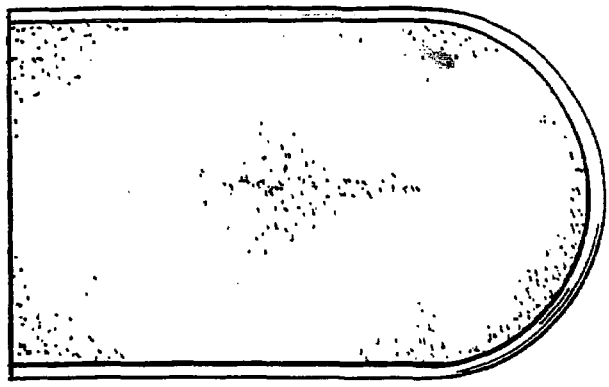
FIG. 13 is a top plan view of a cleaning tool according to a further embodiment of the present invention.

Referring now to FIG. 12, a further embodiment of the present invention is illustrated in the form of a mitt 220. This embodiment has a mitt shaped core 222, which is preferably flexible. As shown, the core 222 is mitt shaped or hand shaped including a thumb portion 224. In this embodiment, a plurality of cleaning sheets 226, which are also mitt shaped, are stacked on one surface of the mitt shaped core 222. FIG. 13 shows a further embodiment of the present invention which may also be considered mitt shaped, though it is without a thumb portion.

In each of the embodiments of the cleaning mitt, each cleaning sheet may include both a backing or moisture barrier layer and a bibulous layer, or may exclude the backing or moisture barrier layer. Also, independent of whether the cleaning sheets include a moisture barrier layer, the bibulous layer may be pretreated with a variety of substances. For example, the bibulous layer may be pretreated with a cleaning solution such as window cleaner or a soap product. It may also be pretreated with a scent compound, a wax, a dusting oil, a shine enhancer, an antibacterial material, hair cleaner, hair conditioner, as well as medical substances.

Certain versions of the present invention may be specifically constructed for use on pets. In this case, the bibulous layer may be pretreated with a substance designed to clean the coat of a pet. Alternatively, or in addition, the layer may be coated with a conditioning agent for the pet's coat. As mentioned previously, medical substances may be included. For example, a skin treatment substance may be embedded in the bibulous layer for application to the skin of a human or pet. Scent compounds applied to the bibulous layer may allow transfer of a scent to the coat of an animal. All or part of the outwardly facing surface of the cleaning sheets may be coated with an adhesive to facilitate collection and retention of debris. For example, the outer surface may be pattern coated with an adhesive so that the cleaning mitt effectively picks up and retains pet hair and dander. A combination of various substances as well as adhesives may be applied to certain embodiments.

A mitt used for cleaning a pet, such as a dog, cat, or a horse, may present a tacky layer to remove loose hair, a dusting sheet to remove dust or dander, and a mopping sheet. Removal of one sheet after use may present another of the same or different type. For example, a dusting sheet may comprise a flexible sheet having a nap, for running through the fur of a pet.

The bibulous pads or the bibulous layers of the above discussed embodiments may be pretreated with a variety of substances. This includes dusting oils and cleaning solutions. As one example, pads or the layer may be pretreated with a dry anti-bacterial substance, which becomes activated with the pad, or layer is wetted. All pads or the entire bibulous layer may be treated with one substance such as the dusting oil or cleaning solution. Alternatively, different portions of the bibulous layer or different bibulous pads may be treated with different substances. As one alternative, the embodiment of the mitt having bibulous pads separated by gaps may have pads treated with one substance alternate with pads treated with a second substance. The first substance may be a solvent while the second substance may be a neutralizer. The pads located on the upper surface point to the mitt would be treated with the first substance while the pads located on the lower surface of the mitt would be treated with the second substance. Therefore, the user would first use the pads located on one of the surfaces to apply the first substance, and then would rotate the mitt 180 degrees to use the pads located on the other surface. As another example, the pads located on the lower surface of the mitt may be treated with a cleaning solution while the pads located on the upper surface of the mitt are not pretreated and therefore merely absorbent. The user would use the pads located on the lower surface to apply cleaning solution to the surface to be cleaned and would then rotate the mitt and use the pad located on the upper surface to absorb the cleaning solution from the surface to be cleaned. Many other variations on this approach fall within the present invention. A cover may be provided to protect the mitt and retain the pretreated materials.

In the embodiment shown in FIGS. 7 and 9, the web of material includes perforations 209 to allow a portion of the web of material to be removed from the remainder of the web. Most preferably, the perforations are located on the leading and trailing edges of the roll so that a portion of the web forming the upper or lower surface may be removed in its entirety, thereby exposing a fresh surface. The perforations may either be cut after the roll is formed or the material may be perforated prior to forming the roll. By "perforations," it is meant that the web has areas designed to tear or separate. This includes the use of a weakened area, a series of small cuts, or one or more large slits. Optionally, a slit across the web may also be employed. Also, the perforations may only be provided on one edge, rather than both the leading and trailing edges.

The cleaning mitt may be configured so as to allow the use of refills. The roll or stack of cleaning sheets can be formed such that they may be removed from a rigid or flexible core and replaced with a new stack or roll. The roll may be formed with some type of core, such as a cardboard tube, or as a coreless roll. Either way, the roll is optionally configured to be placed over the core. Once the roll of cleaning material is used up, a new roll can be placed on the core.

Figure 16:
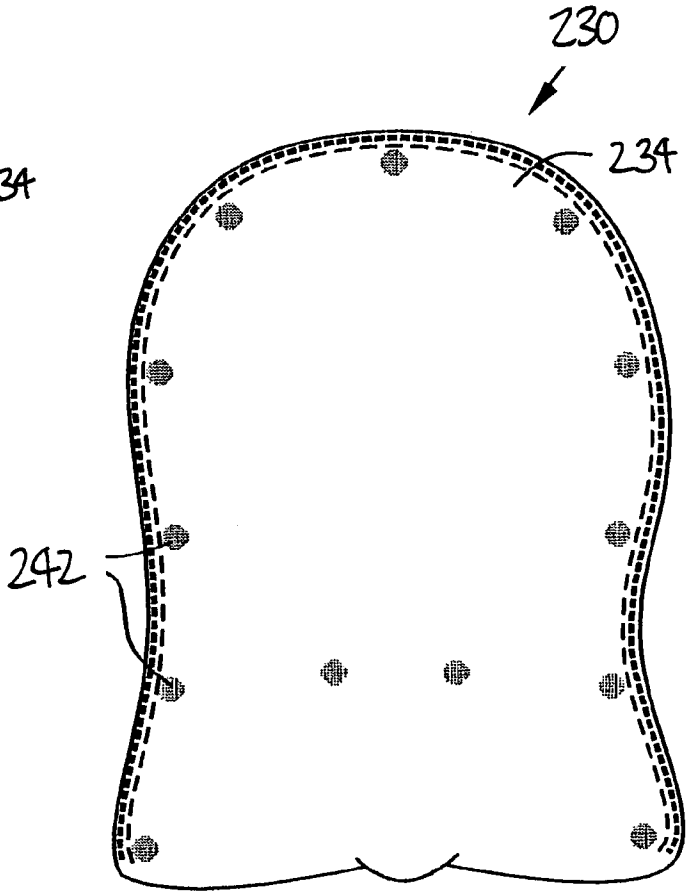
FIG. 16 is a top plan view of the mitt of FIG. 20A.
Figure 15:
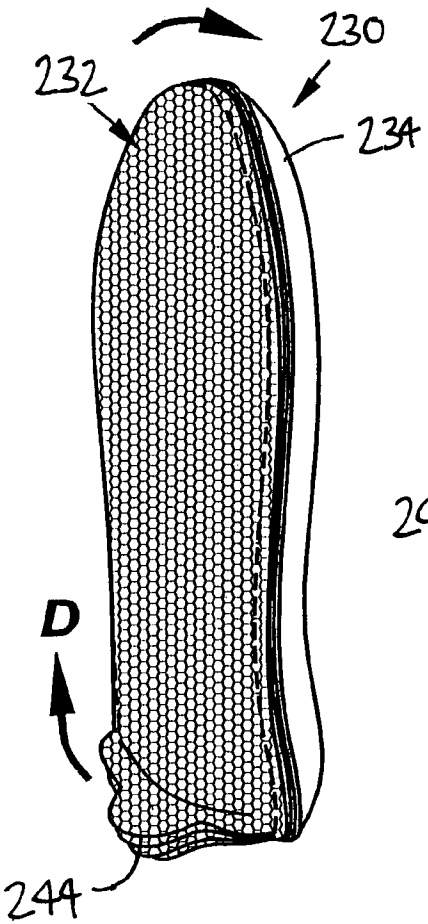
FIG. 15 is a side elevational view of the mitt of FIG. 20A.
Figure 14:
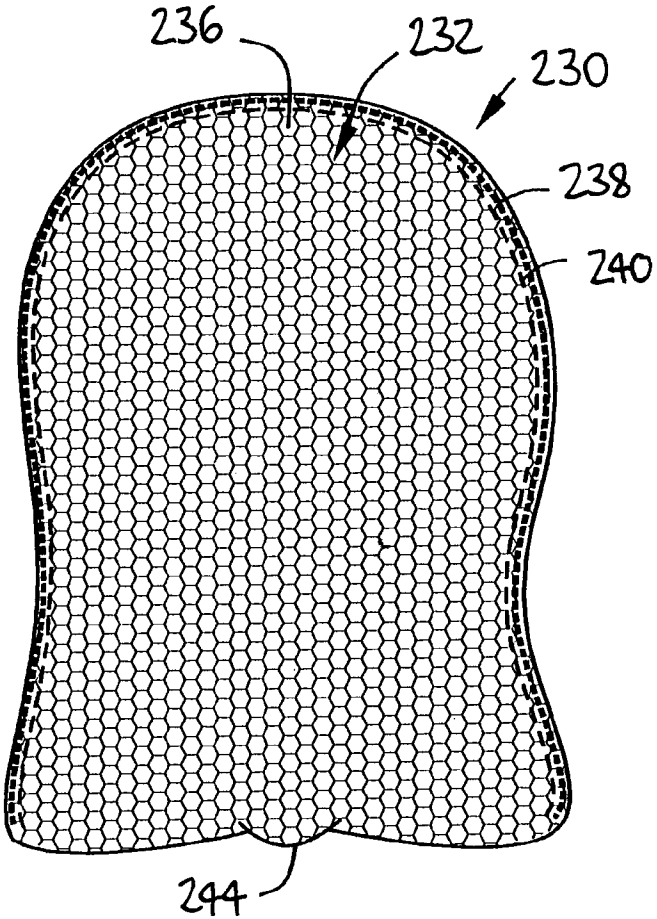
FIG. 14 is a bottom plan view of another embodiment of a mitt according to the present invention.

Referring to FIGS. 14-16, an alternative embodiment of a cleaning mitt is shown generally at 230 having a lower, or cleaning, surface 232 designed to be brought in contact with the surface to be cleaned, and a back or upper surface 234. A stack of cleaning sheets 236 is provided on the lower surface. The cleaning sheets 236 may be maintained in their stacked configuration in any of a variety of ways, such as discussed herein. In one preferred embodiment, the cleaning sheets are each non-woven layers that are sonically or heat welded together at their perimeter as shown at 238. The bottom edge of the perimeter is not joined together so as to leave an opening for inserting a hand between the layers forming a mitt. The perimeter bonding may be continuous, such as a continuous line around the perimeter, or may be discreet points. For example, a series of heat bonded or sonically welded dots may be formed around the perimeter so as to sufficiently join the perimeter. In one embodiment, sonically welded dots with a diameter of 1/32 to 1/8 of an inch are provided around the perimeter. Alternatives include oval, square, or rectangular shaped bonded areas, or shapes such as stars. In this embodiment, the cleaning sheets are preferably formed of a non-woven material. The bonding dots allow an outer sheet to be peeled away by separating the sheet at the bonding points. By properly sizing and forming the bonded dots, peeling away the soiled sheet does not leave behind tufts or portions of the sheet.

As an alternative approach to allowing an outer soiled cleaning sheet to be removed, perforations are provided at points or all the way around the bonded perimeter, as shown at 240. Also, the top end of the mitt may be closed or open. As a further aspect of this preferred embodiment, the upper surface 234 of the mitt 230 may have attachment means provided thereon, such as adhesive or VELCRO®-like material, as shown at 242. These may be dots, strips, a pattern, random, or cover the entire surface. When a cleaning sheet becomes soiled, the user grasps the tab 244 preferably provided at the lower edge of the front side and tears away most of the soiled sheet until it is just attached across the upper edge or side 234 of the mitt. The soiled cleaning sheet may then be folded over the top or side of the mitt as shown by arrow D until the soiled side of the cleaning sheet is against the upper side 234 of the mitt 230. It is then held in place by the attachment means. The user then turns the mitt over on their hand and uses it to clean with the reverse side of the cleaning sheet that has been turned over onto the upper side of the mitt. After the reverse side is soiled, the sheet may either be left in place, or torn off the rest of the way. As will be clear to those of skill in the art, the cleaning sheet may also be held in its reverse position in a variety of other ways. For example, a static cling may be provided for holding the sheet in place, or no attachment means may be provided, in which case, the cleaning sheet is held in place on the upper surface of the mitt by the force of the user's hand during a cleaning operation. As another alternative, each of the cleaning sheets may have a backing or moisture barrier layer, and may also have a cleaning layer on the underside of the backing layer such that when the sheet is reversed, a clean cleaning layer is exposed.

The mitt in FIGS. 14-16 may include cleaning sheets that are co-extensive with each other to form the mitt, or may include a base mitt with cleaning sheets disposed thereon, as disclosed earlier. In either version, two backing layers may be interconnected to form a base mitt for receiving the hand, or no base mitt is provided with the individual cleaning layers instead forming the mitt. In another version, a single layer of plastic is provided with the cleaning layers connected thereto. The plastic layer then ends up on the back of the user's hand when wearing the mitt. Attachment means may be provided on the plastic layer for holding a cleaning sheet that is partially torn off and folded over the mitt to lie against the plastic sheet.

As another alternative, a cleaning mitt, such as illustrated at 230 in FIGS. 14-16 may be formed by interconnecting a plurality of sheets of a non-woven or cleaning material. In this embodiment, each of the cleaning sheets is coextensive and interconnected at some of its edges by an adhesive or heat, sonic, or mechanical bonding. Alternatively, the individual sheets may be sewn or otherwise interconnected at their edges. Preferably, the sheets are interconnected along three sides so as to leave an opening for inserting a hand. Because the plurality of sheets are not interconnected at the opening side, a hand may be inserted between any of the sheets, such that the hand is positioned in the middle of the stack or elsewhere. This allows variation in the thickness of cleaning material between the hand and the surface to be cleaned.

Preferably, the cleaning sheets are each perforated just inboard of the joined outer edges so as to allow a soiled outer sheet to be removed. Alternatively, some or all of the cleaning sheets may be two layer with a cleaning layer and a moisture barrier or backing layer. In the embodiment in which each cleaning sheet is a single layer of non-woven material, the non-woven material may be the same or similar to materials used in refill sheets for SWIFFER® and GRAB-IT® mops. As with the previously discussed embodiments of a cleaning mitt, the cleaning mitt constructed of multiple co-extensive layers may be designed such that a layer may be partially torn away and wrapped about the mitt so as to use the backside of the cleaning sheet for further cleaning. The approach of providing cleaning sheets which may be partially separated and turned over to use the opposite side may also be used with a refill for a mop. For example, the mop head may be designed such that it is reversible and individual sheets of the refill may be partially peeled away and folded over onto the opposite side of the mop head. Additional gripping means may be provided for holding the cleaning sheet in the reversed position. The reversed sheet then may be used for additional cleaning.

Figure 17A:
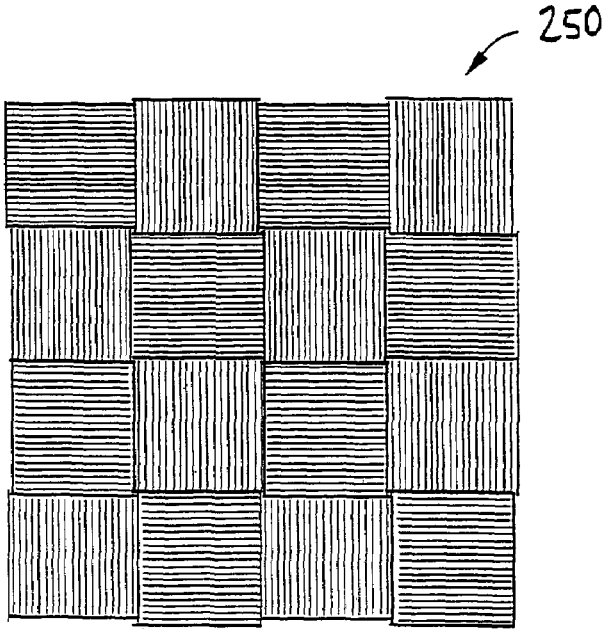
FIG. 17A is a plan view of one embodiment of a cleaning material for use with cleaning mitts and implements according to the present invention.
Figure 17B:
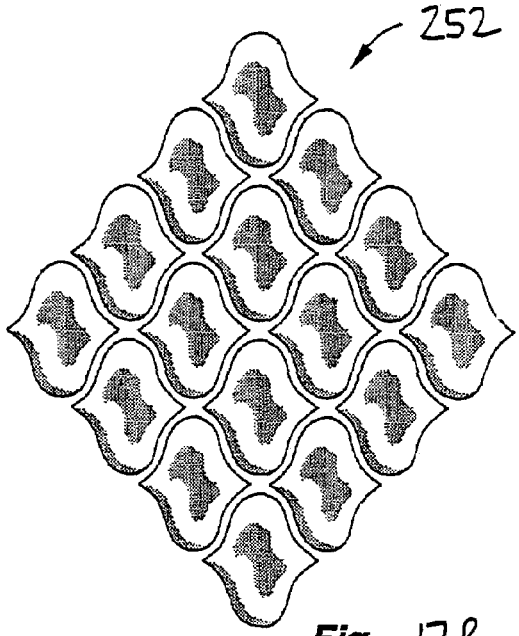
FIG. 17B is a plan of an alternative embodiment of a cleaning material.
Figure 17C:
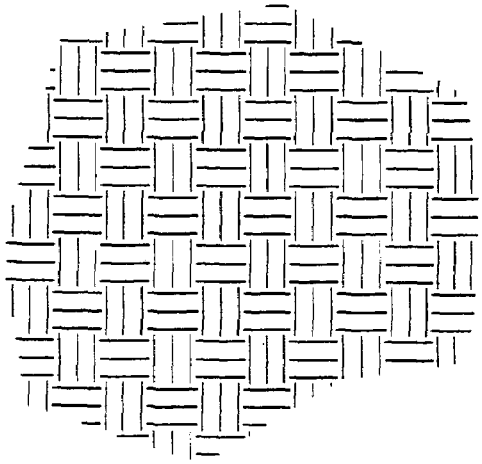
FIG. 17C is a plan view of yet another alternative embodiment of the cleaning material.
Figure 17D:
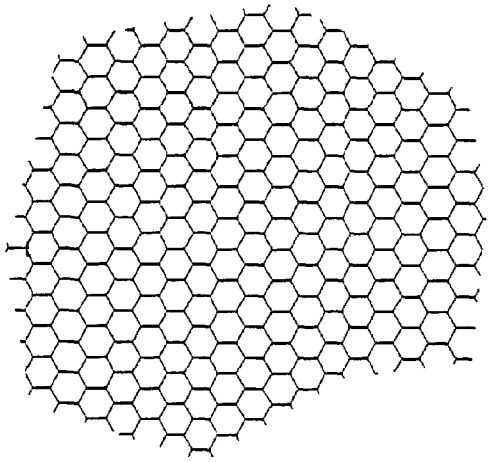
FIG. 17D is a plan view of yet another alternative embodiment of a cleaning material.
Figure 23:
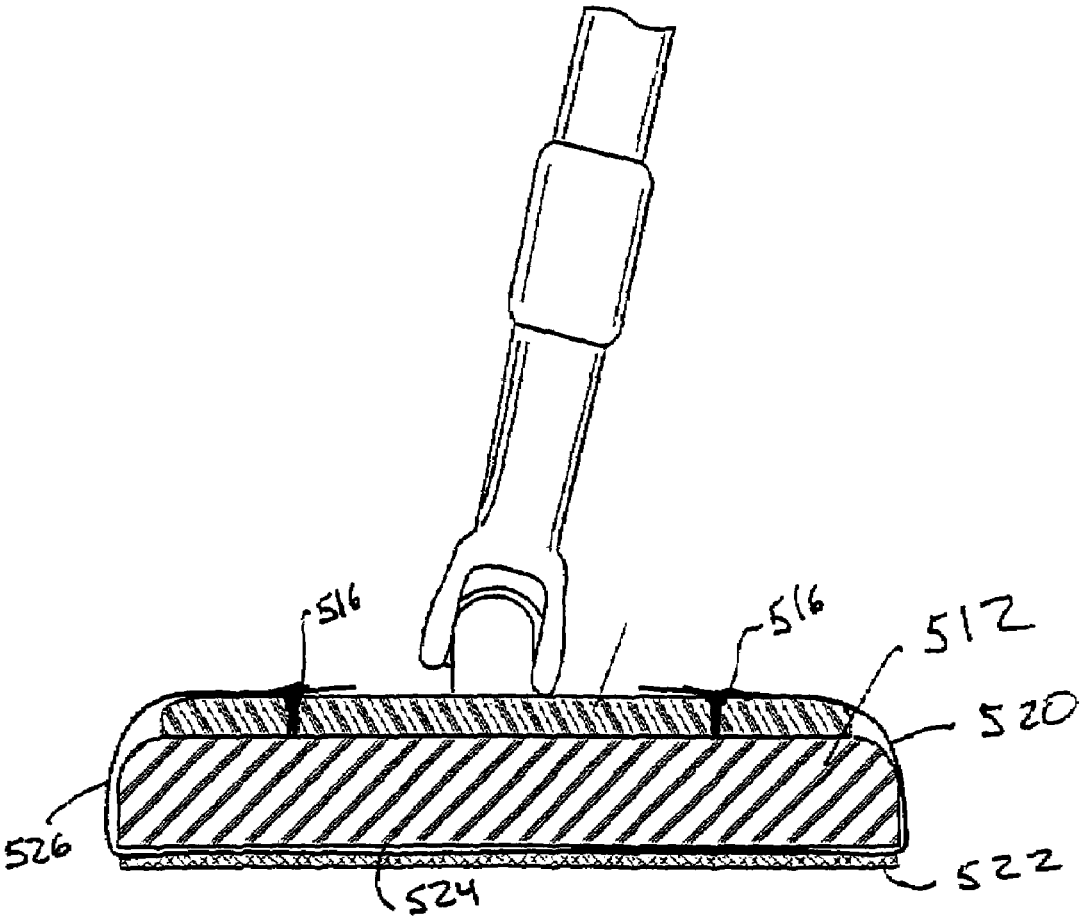
FIG. 23 is a side elevational view of a mop head showing a refill attached.

FIGS. 17A-17D illustrate alternative versions of non-woven material and may be used to form the cleaning layer for any embodiment of the present invention. In FIG. 23, a non-woven material 250 has a somewhat woven appearance with strands positioned above and below crossing strands so as to give a more three-dimensional texturized affect. This material is considered non-woven since it is not formed with traditional weaving techniques. The material may include reinforcing scrim, as needed. An alternative non-woven material 252 is shown in FIG. 17B. The material 252 represents the material used for SWIFFER® cleaning sheets. It may also have reinforcing scrim. FIGS. 17C and 17D illustrate yet other alternative embodiments of cleaning material. Some types of cleaning material for use with the present invention are considered multi-dimensional, in that they have a more textured surface. In any embodiment of the present invention, the cleaning sheets may be treated with a perfume or cleaning material, and/or coated or pattern coated an adhesive. The embodiments wherein an adhesive coating is used, a pattern coating is preferred. In pattern coating, only a portion of the surface is actually covered with adhesive, thereby allowing the cleaning material to remain absorbable to or to release materials therefrom, such as cleaning solution or perfume. Additional adhesive may be provided in certain areas to gab and hold debris such as hair.

As yet another alternative embodiment of a cleaning mitt, a pre-moistened mitt or pre-moistened mitt kit may be provided. The mitt would be formed of two or more layers of material, including at least one absorbent layer. The mitt would be provided with a generally moisture impervious container to maintain moisture therein. A kit may be provided with a dry mitt inside of a moisture-proof container along with a cleaning solution to be added to the container to pre-moisten the mitt. Alternatively, the customer may add their own cleaning material. The cleaning solution is either pre-added or added by the customer to the container such that the mitt absorbs the cleaning material. Preferably, the mitt has a moisture impervious liner that the user places their hand in, such that the cleaning solution does not contact the hand. The package may be designed such that the user may place their hand into the moisture impervious liner of the mitt prior to removing the packaging that seals the mitt. The packaging is then torn away to expose the treated cleaning material. Alternatively, the liner could be sealed with a portion being torn off at perforations or a weakened area to access the liner.

In any mitt embodiment of the present invention, the mitt may be generally hand shaped with or without a thumb opening. The embodiments of FIGS. 14-16 lack a thumb region, thereby allowing them to be used on either hand. Alternatively, a thumb portion may be provided. Also, the mitt may not necessarily be hand shaped. Instead, it may be more rectangular or square, or other shape.

Other variations on the cleaning mitt are also possible. Any of the configurations discussed with respect to the mop may be applied to the mitt.

Mop Refills

Figure 18A:
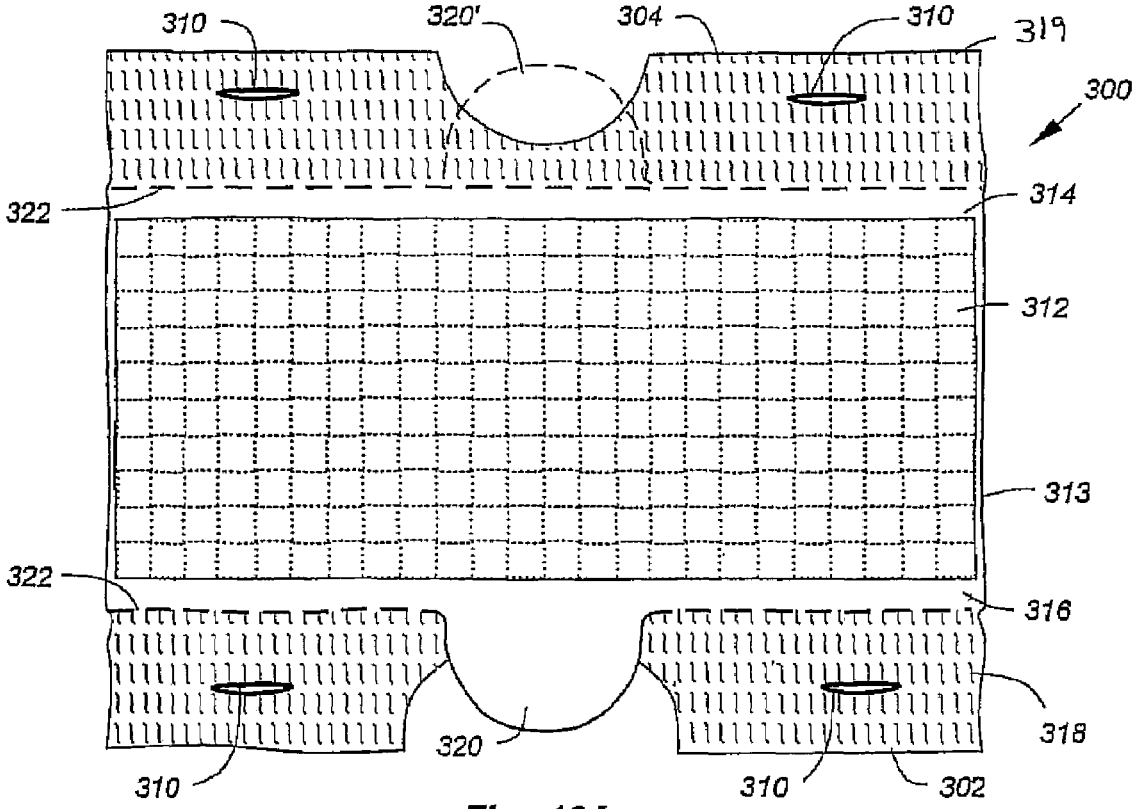
FIG. 18A is a plan view of a refill for a mop according to the present invention.
Figure 18B:
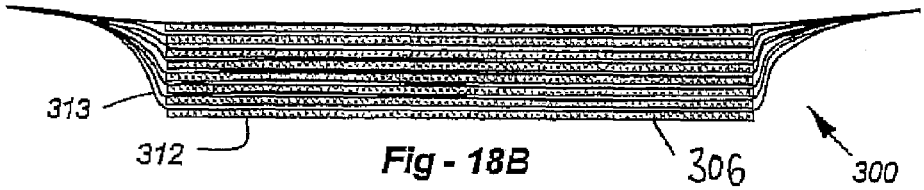
FIG. 18B is an end view of one embodiment of a refill for a mop.

Referring now to FIGS. 18A and 18B, an additional embodiment of a refill for a mop or cleaning tool is generally shown at 300. The refill 300 is designed to provide the benefits of previous versions of the present invention for use with mops or cleaning tools designed to use disposable single cleaning sheets. Examples of these mops include the SWIFFER® and the GRAB-IT® mops. These mops have a mop head with a lower surface that is generally smooth and flat and an upper surface with gripping members for gripping the edges of a cleaning sheet. A single disposable cleaning sheet is wrapped around the mop head and the edges of the cleaning sheet are gripped by the gripping members to hold the cleaning sheet in position on the lower surface of the mop head. These cleaning sheets are typically not designed for wet use, but instead for light duty cleaning, such as dusting. Refill 300 is designed for use with this type of mop, but may also be used or adapted for use with other types of mops, as will be clear to those of skill in the art.

The refill 300 has a pair of opposed edges, a front edge 302 and a rear edge 304. A plurality of cleaning sheets 306 are supported between the edges 302 and 304. In other embodiments, the opposed edges may be the side edges. Referring to FIG. 18A, slits 310 may be seen near the edges 302 and 304 of the refill. These slits may be used for attaching the refill to a mop head, for example the tabs 307 of the mop head 308 shown in FIG. 19A.

There are several variations on the refill 300. In one embodiment, a plurality of cleaning sheets is provided in a stacked configuration, with each of the cleaning sheets consisting of a cloth-like cleaning layer and a backing layer. This embodiment is shown in FIG. 18B. The cloth-like cleaning layer may be made from a wide variety of materials. As discussed previously, non-woven, spun-bonded, or spun laced fibrous sheets may be used as a bibulous layer. As discussed previously, "bibulous" is defined as having the ability to absorb a liquid. The term "cleaning layer" or "cloth-like layer" includes bibulous layers of all types, as well as cleaning layers that may be less absorbent. Generally, a cleaning layer varies between being highly absorbent and being capable of holding a strong static charge. For some dusting and cleaning applications, a static charge is desirable in order to collect and retain dust. However, some fabrics with strong static bearing capabilities are only slightly bibulous or may actually repel water. Between the extremes of strong absorbency and strong static carrying capability are materials that work reasonably well for both applications. Cloth-like cleaning layers for use with the present invention may be any of these materials, including bibulous and non-bibulous materials, woven and non-woven materials and fibrous materials including paper towel-like cloths. An example of a material that has high static carrying capability is PET (polyethylene terephthalate) and similar materials. A blend of PET and a material such as rayon gives some static carrying capability and some absorbency.

The backing layer may be any of a variety of materials that provide support to the cleaning layer, including a moisture barrier sheet or layer, as discussed with previous embodiments of the present invention. Alternatively, the backing layer may be a paper or other material capable of absorbing or passing moisture. Also, the backing layer may assist in the cleaning function of the cleaning sheets. For example, the backing may help to provide or hold the static charge or may include an adhesive for collecting and retaining debris. In one embodiment, the backing layer is a non-woven material that may be the same or different from the cleaning layer which may be a non-woven material. For example, the backing layer may be thinner and/or denser. The backing layer could also be a mesh or scrim layer.

Referring to FIG. 18B, the backing layers of each cleaning sheet may extend beyond the edges of the cleaning layer at the front and rear edges. In FIGS. 18A and B, the cleaning layer is shown at 312 for the outermost cleaning sheet, with the backing layer 313 extending beyond the cleaning layer and forming a front margin 316 and a rear margin 314. The margins of each of the cleaning sheets are then interconnected, such as by adhesive or bonding. The interconnected areas 318 and 319 are shown by patterned areas in the margin areas. The interconnected portions will be referred to as bonded, with "bonded" including any approach to interconnecting the edges. In one preferred approach, heat bonding or sonic welding is used, which essentially transforms the multiple individual layers into a single merged layer. By interconnecting just the backing layers, which may be a thin plastic, paper, or non-woven material, the margins are much thinner than if the cleaning layer continued to the very edge. Also, this approach conserves the cleaning layers for the zone that is actually used for cleaning purposes, rather than the portion of the refill that wraps around the top of the mop and is not used for cleaning.

Because the edges are thin, they can be attached to the gripping means, such as tabs 307, used on a mop designed for a single sheet at a time. Preferably, the edges of a refill according to the present invention for use with a mop head with gripping means have a thickness of ¼ inch or less, with ⅛ inch or less even more preferred. It is notable that the edges in various embodiments of the present invention are preferably much thinner than the midportion. For example, in the embodiment of FIG. 18B, the midportion may have a thickness of a ½ inch, ¾ inch, or 1 inch or more, while the edges may have a thickness of significantly less than ⅛ of an inch.

As with other embodiments of the present invention, the cleaning layer may be interconnected with the backing layer by any of a variety of approaches, including adhesive, or bonding. Alternatively, they may be integrally formed. Also, adhesive may be applied to a portion of the margins on either the front margin, the rear margin, or both. The adhesive in the margin, if provided, serves two purposes. First, it helps to grab and hold debris that is pushed ahead or drug behind the cleaning layer. Secondly, when removing the soiled outer sheet, the adhesive coated margins help prevent dirt from falling off of the soiled cleaning sheet and allow the cleaning sheet to be crumpled with the adhesive sticking to other portions of the sheet.

Intermediate the bonded portions of the margins and the area where the cleaning layer is connected, perforations 322 are preferably provided. The perforations may be adjacent the cleaning layer 312, or farther outboard. Perforations allow for separation of the inner portion of each cleaning sheet from the interconnected edges once the outermost cleaning sheet is soiled. Tabs 320 are preferably provided adjacent the front edge 302 for grasping by a user to remove the soiled cleaning sheet. As discussed previously with respect to other embodiments of the present invention, other approaches to allowing separation of an individual sheet may be provided. For example, instead of perforations, weakened areas may be provided. An optional rear tab 320 may be provided adjacent to each of the rear edges 304 of the refill 300. The second tab 320' allows the outermost soiled sheet to be pulled away from either side and also allows a user to grip a tab on the front and rear to minimize soiling of their hand and flipping of debris off the sheet.

Figure 18C:
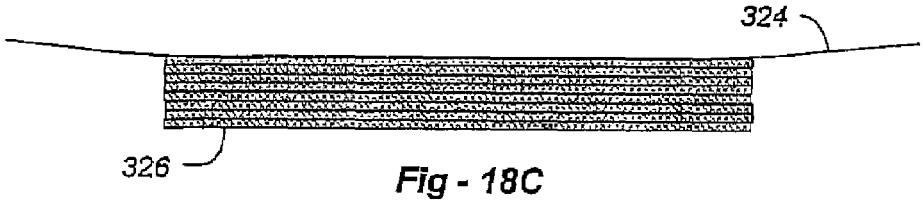
FIG. 18C is an end view of an alternative embodiment of a refill for a mop.

As another alternative, a single backing sheet may be provided with individual cleaning sheets interconnected with the backing sheet by adhesive or stapling, sonic, heat or mechanical bonding, or other approaches. This approach is shown in FIG. 18C. The single backing sheet 324 may then be wrapped around the mop head and attached to the gripping means. The backing sheet may just be a larger, stronger and/or thinner or thicker cleaning sheet than the remaining cleaning sheets. As another alternative, the refill may be provided with only cleaning layers, rather than with alternating backing layers. For example, a stack of bibulous material sheets, such as non-woven sheets 326, may be stacked on a backing sheet 324 that is wrapped around the mop head, with individual sheets 326 being peeled away as they become soiled. All or portions of the bibulous sheets 326 may be bonded together, or otherwise interconnected.

In the embodiment of FIG. 18C, the cleaning sheets 326 are formed into a stack that is generally centered on the backing sheet 324. They are sized such that each of the cleaning layers 326 is disposed on the lower surface of the mop head when the backing sheet 324 is wrapped around and connected to the gripping means on the upper side of the mop head. That is, the cleaning layers or sheets 326 do not wrap around the mop head. Tabs or nonadhesively attached portions of the cleaning sheets 326 may be provided to ease gripping and removal of a soiled outer sheet. The cleaning sheets 326 may be treated or pretreated with cleaning material or with adhesive, depending on the application. They may also be statically charged. As one example, the cleaning sheets may be pretreated with a tackifier or may be formed of materials that are naturally tacky or staticy (readily acquiring a static charge, for example when separated from or rubbed against another material) so as to aid in picking up and retaining debris. The cleaning sheets may be formed in accordance with any of the other embodiments of the present invention.

Alternatives on the version of FIG. 18C include extending the cleaning sheets further to the sides so that they partially wrap up around the edges of the mop. Another alternative includes providing each of the layers in the stack on the backing sheet 324 with multiple layers. For example, each sheet may include a bibulous layer and a moisture barrier layer, but with each layer supported in a stack on the backing sheet and smaller than the backing sheet. In any of the embodiments, the individual sheets may be interconnected with adhesive or in any other way that allows individual soiled sheets to be torn away as they are used. As one example, individual sheets may be interconnected with each other by heat bonding or sonically welding the sheets together in small areas, such as dots. Alternatives include oval, square, or rectangular shaped bonded areas, or shapes such as stars. By providing a plurality of these small bonded areas, the sheets may be reliably retained in the stacked configuration. At the same time, by choosing appropriately sized small bonding areas, a sheet may be peeled away by separating a sheet at each of the bonded areas. If the bonded areas are small enough in diameter and properly formed, when the soiled outermost sheet is separated, the sheet should cleanly separate without leaving behind tufts or portions of the soiled sheet. As yet another alternative, a backing layer may be provided behind each cleaning layer, but with the backing layer not necessarily being a moisture barrier layer. For example, the layer may be porous, or otherwise incapable of preventing penetration of liquid. As another alternative, a moisture barrier layer may be provided as a coating on a cleaning layer, rather than being an individual sheet of moisture barrier material. The cleaning sheets may be held in their stacked configuration by either sonic, heat, or mechanical bonding, adhesive, or being stapled to one another adjacent their edges. Preferably, the staples, if used, are embedded or placed far enough towards or around the edges such that they do not contact the surface to be cleaned during use.

Another alternative embodiment of a refill for a mop head designed to receive a single cleaning sheet would include a stack of cleaning sheets with each cleaning sheet consisting of a moisture barrier layer and a bibulous layer. In this embodiment, the moisture barrier layers and the bibulous layers are coextensive such that both layers extend entirely to the edge. The edges may then be interconnected in any of the previously described ways such that the edges may be attached to the gripping means on the top side of the mop head. The moisture barrier layers may be sheets of plastic or a coating. Alternatively, the refill may include sheets each with multiple layers, with the layers not including the moisture barrier layer.

Figure 18D:
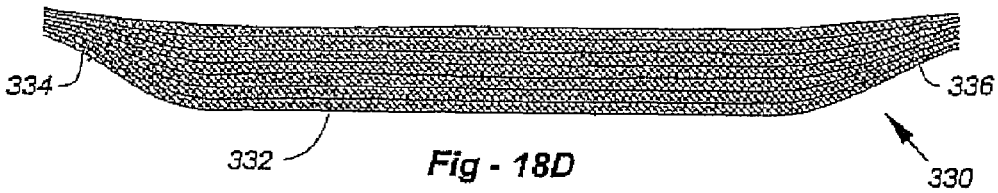
FIG. 18D is an end view of another alternative embodiment of a refill for a mop.

FIG. 18D shows another alternative embodiment of a refill 330 which consists of a stack of individual cleaning sheets 332 that are generally coextensive such that the entire stack is wrapped around the mop head and attached to the gripping means on the upper side of the mop head. The leading edge 334 and trailing edge 336 of the refill 330 consists of the individual cleaning sheets being compressed and bonded together, such as shown. In the illustrated embodiment, each of the cleaning sheets 332 consists of a single non-woven cleaning layer. The portion of the individual layers adjacent the edges are interconnected such as by heat, sonic, or mechanical bonding or by other means. High pressures and/or temperatures may be used so as to significantly reduce the overall thickness near the edges to allow for easier interconnection with a mop head. Preferably, the thickness of the edges is reduced to less than a ¼ inch, and more preferably to less than a ⅛ of an inch. This may amount to a significant reduction in thickness. For example, the midportion of the stack, where the individual sheets are not compressed, may have a thickness at least three times greater than the compressed edges. In some embodiments, the thickness ratio may be 6:1, 8:1, or more. Slots may be provided adjacent to edges for interconnection with tabs, as previously discussed. In one preferred version of this embodiment, the sheets are configured as was shown with the embodiment of FIG. 18A. That is, perforations may be provided intermediate the interconnected edges and the central portion of each sheet so as to allow removal of the central portion of each sheet as it becomes soiled. Alternatively, weakened portions may be provided. Tabs on the leading and/or trailing edges may be provided to assist in removing each outer sheet. The individual sheets may be treated with an adhesive or otherwise made tacky to assist in cleaning. The sheets may also be static treated or designed to develop a static charge when passed over a surface to be cleaned. The sheets may be retained in the stacked configuration by the bonded edges, or may include staples or an adhesive or other interconnection means for further interconnecting the sheets.

As further alternatives, the individual cleaning sheets may be somewhat thicker in their central portions and thinner near the edges to allow for easier gripping by the mop head. That is, each individual sheet would have a thicker central portion and a thinner edge portion prior to the edge portions being compressed and bonded to one another. Such a dual thickness sheet may be created by interconnecting two layers, with one layer being smaller than the other such that it does not extend to the edges. Alternatively, it may be integrally formed. As another alternative, backing layers may be provided either for the entire stack or for individual sheets, with the backing layer being materials other than plastic, such as a different type of non-woven material or paper. A refill, similar to as shown in FIG. 18A, may also be constructed in accordance with any other embodiment of the present invention. As one example, pretreated bibulous layers may be centered between moisture barrier layers so that they are sealed in. In this way, a wet, clean sheet may be provided that remains wet due to the fact that it is sealed in.

Preferably, for a refill according to the present invention to work best with a mop head of the type designed to receive a single cleaning sheet, the edges, whether bonded or consisting of a single backing layer, are significantly thinner than the portion of the refill between the edges. For example, in the embodiment of FIG. 18B, it can be seen that the central portion of the refill is substantially thicker than the edges. In order to work with a mop head designed to receive a single sheet, it is preferred that the edges of the refill have a thickness less than ¼ inch. Thicknesses less than this, such as ⅛ inch or less, may work even better, with less thickness being most preferred. The mid portions of the refills, on the other hand, can be substantially thicker since the thickness does not interfere with interconnection with the mop head. A refill can include at least three cleaning sheets, for example, four, five, or more. In some embodiments, as many as 10-30 or more cleaning sheets are included in a refill. A stack of cleaning sheets that each include a cleaning layer, such as a non-woven fabric-like material, may have a thickness from ½ to 1 inch in the center portion, though it may be thicker or thinner for certain applications. In an embodiment such as shown in FIG. 18B, and wherein the refill includes 10 cleaning sheets, the thickness in the mid portion may be ½-1 inch or more while the margins have a thickness of only ⅛ inch or less. Obviously, the embodiment of FIG. 18C has a very thin margin, since it consists of only a single backing sheet 324. In this case, the backing sheet may have a thickness of one one-thousandth or less, while the cleaning layers 326 may have a total thickness of ½ inch or so for a 10 layer refill. The embodiment of FIG. 18 appears to have much thicker margins, though this embodiment may also be created with much thinner margins. For example, the margin areas may be compressed and bonded sufficiently to have a thickness less than ¼ inch with a thickness, with a thickness less than ⅛ inch even more preferred.

Figure 19A:
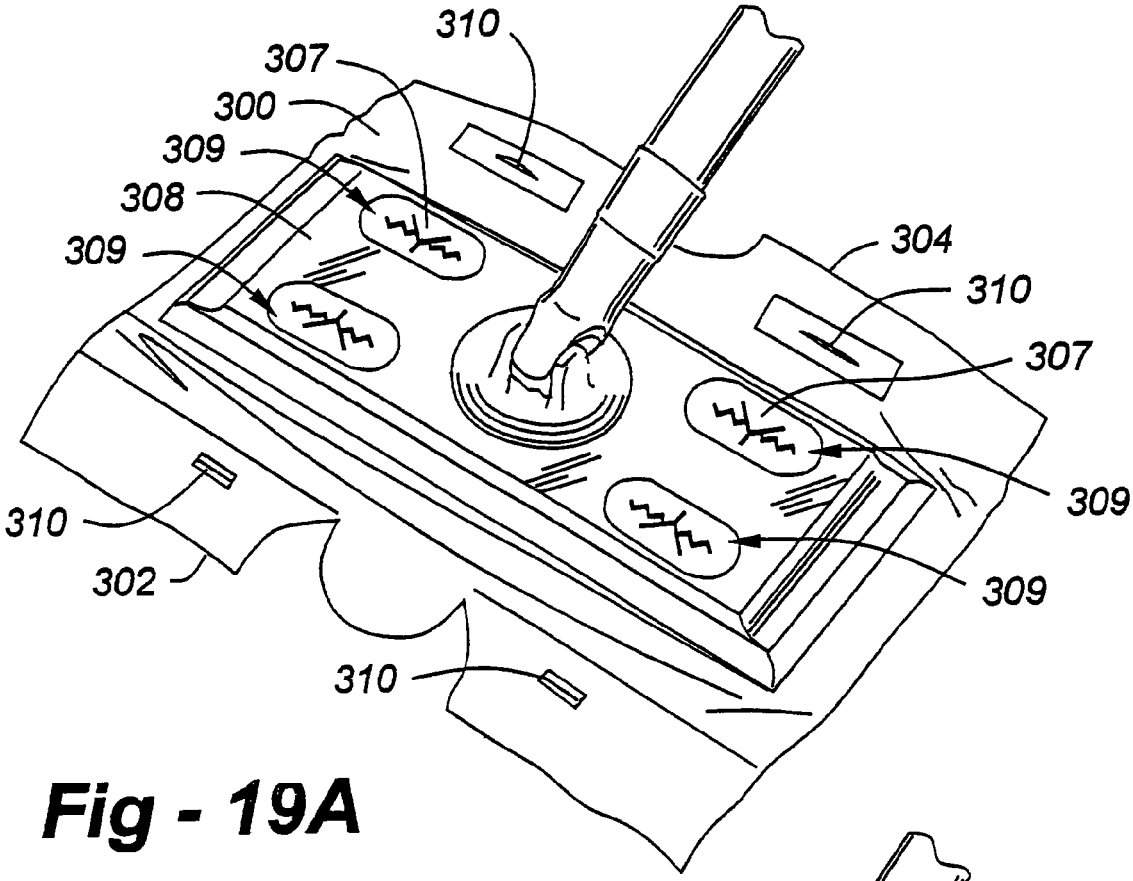
FIG. 19A is a perspective view of a mop head positioned for attachment of a refill according to the present invention.
Figure 19B:
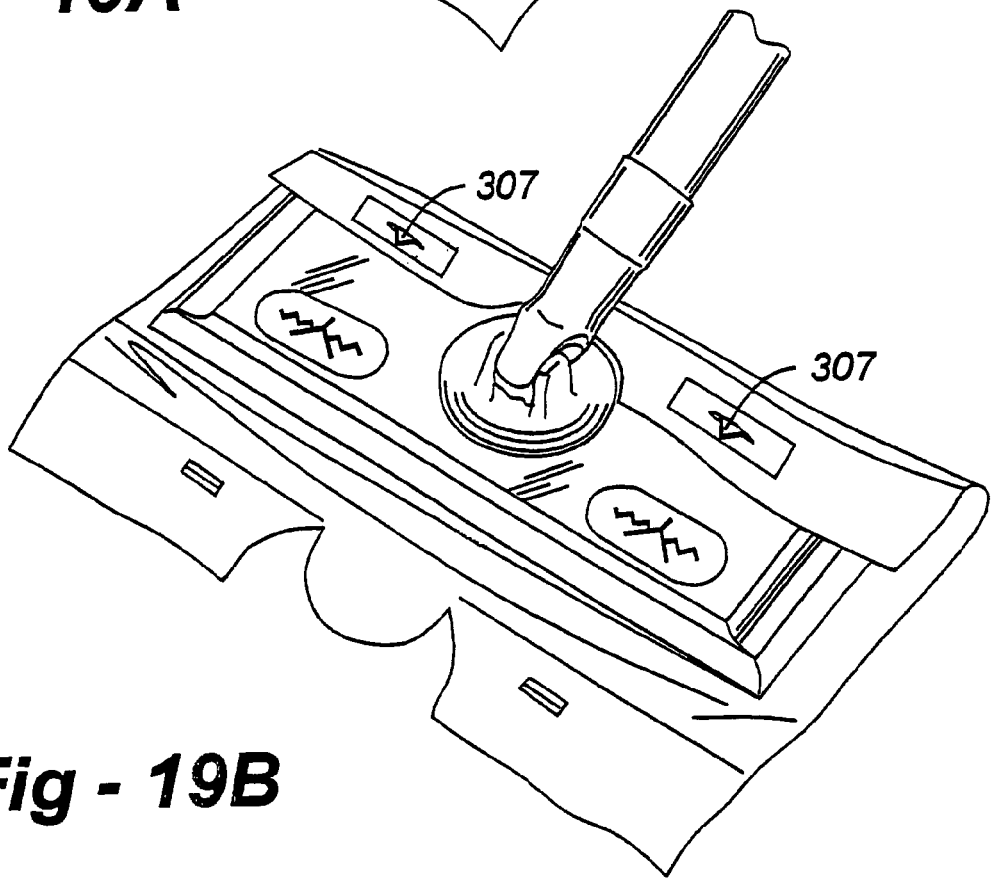
FIG. 19B is a perspective view similar to FIG. 19A, with one edge of the refill attached to the mop head.
Figure 19C:
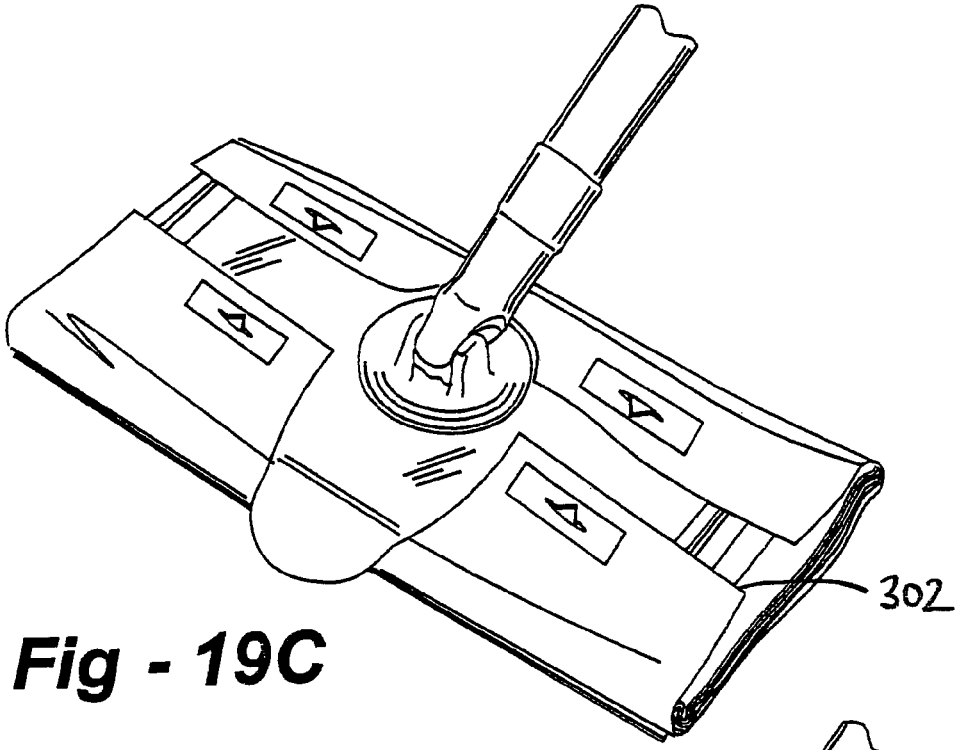
FIG. 19C is a perspective view similar to FIGS. 19A and 19B showing both edges of the refill attached to the mop head.

Referring now to FIGS. 19A-19D, the refill 300 is shown during installation and use. Referring to FIG. 19A, a generally rectangular mop head 308 is shown placed against the rear or upper surface of the refill 300 intermediate the edges 302 and 304. FIG. 19B shows the rear edge 304 wrapped around the rear edge of the mop head and attached to the upper surface. FIG. 19C shows the front edge 302 wrapped around the mop head and attached to the upper surface. As will be clear to those of skill in the art, the gripping members that hold the refill to the mop head may be of several types. In one preferred embodiment, the mop head has attachment tabs 307 that extend generally upwardly and inwardly from adjacent the outer edges of the top surface of the mop head. Slits near the edges of the refill are placed over these tabs to hold the refill in place. As an alternative, clips or clamps may be provided on the top side of the mop head. As yet another alternative, adhesive may be used to hold the refill in place. For example, the refill may have adhesive strips, such as used on disposable diapers, which can be used to attach the refill to the mop head or to itself. The approach such as used for attaching sandpaper to a sanding block may also be used. The mop head 308 illustrated in FIGS. 19A-19D has irregular cut grippers 309 generally near the four corners of the rectangular mop head. The grippers 309 are cut so as to define the tabs 307. Alternatively, edges of a cleaning sheet or the refill 300 may be pressed into the grippers 309 to hold the edges.

Figure 19D:
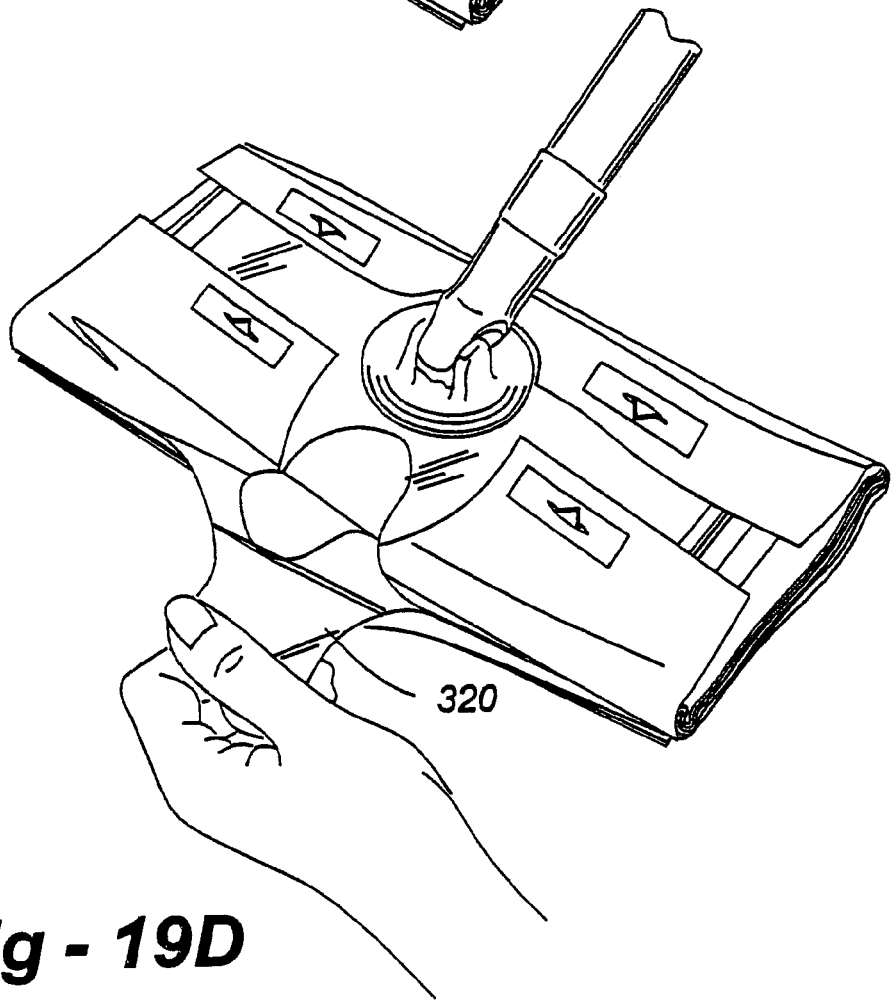
FIG. 19D is a perspective view of a mop head with a refill installed thereon, showing a soiled outer sheet being removed.

Preferably, the refill 300 consists of multiple cleaning sheets in a stacked configuration. FIG. 19D shows an outermost soiled cleaning sheet being removed from the remainder of the refill using tab 320.

The embodiments of the refill shown and discussed with respect to FIGS. 18A-18D and 19A-19D may also be configured as a refill for a handheld cleaning tool, or as a cleaning mitt. For example, the base layer may be provided with a pocket in which a person may insert their hand so that the refill may be worn as a mitt. The refill may also be configured into other shapes and sizes to work more easily as a mitt. Each of the alternative embodiments may be adapted for use as a mitt. In one preferred embodiment, the mitt includes a mitt-shaped wearable base with a stack of cleaning sheets attached to one or more of its surfaces. Each cleaning sheet may include a bibulous layer and a moisture barrier layer, or may include only a cleaning layer. As with all embodiments of the present invention, the bibulous layers may be pretreated with cleaning solutions or other liquids.

Figure 20:
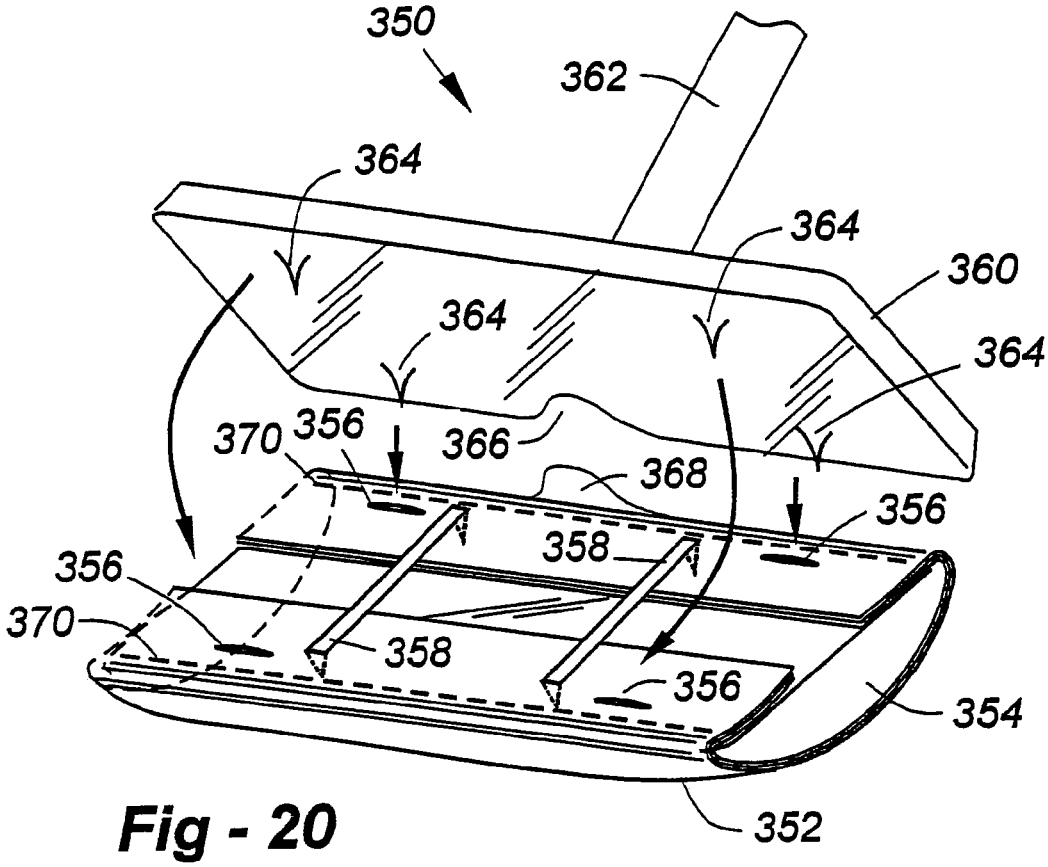
FIG. 20 is a perspective view of another embodiment of a refill for a mop along with the holder portion of the mop.

Referring now to FIG. 20, an additional embodiment of a mop 350 is shown. In this embodiment, cleaning sheets 352 are wrapped about a mop head 354, as shown. Together the stack of cleaning sheets 352 and the mop head 354 form a mop head refill. The mop head refill has holes 356 formed in its top. Staples 358 may be used to hold the stack of sheets 352 to the mop head 354. Alternatively, the cleaning sheets may be attached to the head 354 in any other way, including adhesive, sonic, heat, or mechanical bonding, or hot sealing. The head and sheets may also be integrally formed.

Shown above the mop head refill, a plastic holder 360 is shown with a mop handle 362 extending upwardly therefrom. The holder 360 has spikes 364 extending downwardly therefrom designed and positioned to engage the holes 356. An indentation 366 is provided to access pull tabs 368 so as to allow removal of dirty outer sheets from the stack 352. Once all of the sheets in the stack 352 are used, the mop head 354 may be removed from the holder 360 and replaced with a new refill. The mop head 354 may have a curved lower surface, as shown, or may be more rectangular with a flat bottom surface. The mop head 354 may be constructed of a variety of materials.

In one embodiment, the mop head 354 is a disposable foam or paper material with the cleaning sheets attached thereto. The cleaning sheets 352 may be constructed in accordance with any embodiment of the present invention. For example, each sheet may be a single layer of cleaning material, or may include a backing layer. The sheets may be pretreated with cleaning solution or with a tackifier, or may be naturally tacky. The leading and trailing edges may be adhesively coated to additionally gather debris. Perforations 370 may be provided for releasing the outermost soiled sheet, or weakened areas may be provided, or the sheets may be adhesively interconnected such that the outer sheet may be peeled away. It should be noted that the mop head 354 with the cleaning sheets 352 may be used as a cleaning implement without the remainder of the mop 350.

Figure 21:
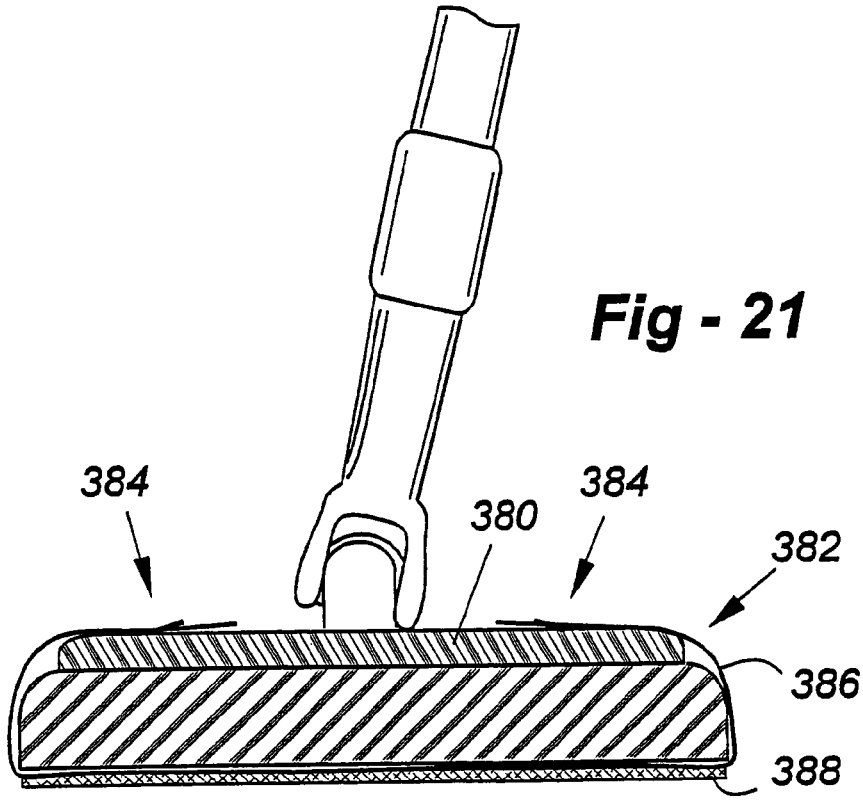
FIG. 21 is a side elevational view of a mop head similar to that shown in FIGS. 19A-19D with an alternative embodiment of a cleaning sheet according to the present invention attached thereto.

Referring now to FIG. 21, a disposable single sheet cleaning refill is illustrated. A mop has a mop head 380 with a design similar to the design discussed with respect to FIGS. 19A-19D. A cleaning sheet 382 is wrapped about the mop head 380 with its edges held by gripping members 384. In the illustrated embodiment, the sheet 382 has a backing layer 386 with a cleaning layer 388 attached thereto. The cleaning layer 388 is connected to the central portion of a backing layer 386 such that it is positioned only on the lower surface of the mop head 380 when the sheet 382 is installed thereon. Alternatively, the cleaning layer 388 may wrap up around the sides. As yet another alternative, the cleaning layer may wrap completely around the mop head and/or be coextensive with the backing layer 386. The backing layer may be plastic or paper or any other material suitable to function as a support layer. In embodiments where the cleaning layer and backing layer are coextensive, a moisture barrier layer may be provided as a coating on the back of a cleaning layer. As one alternative, the sheet 382 may have an outer cleaning layer with a strengthening backing layer, which is not necessarily a moisture barrier layer. This backing layer may be a different type of non-woven, or any other material that functions to allow the sheet to be attached to the gripping means of the mop head. As just one preferred embodiment, the backing layer is a thin, strong, non-woven layer to which a non-woven cleaning layer is attached to the center thereof such that the cleaning layer is positioned just on the lower surface of the mop head when the sheet is attached thereto. The cleaning sheet 382 may be constructed in accordance with any of the embodiments of the present invention.

Figure 22:
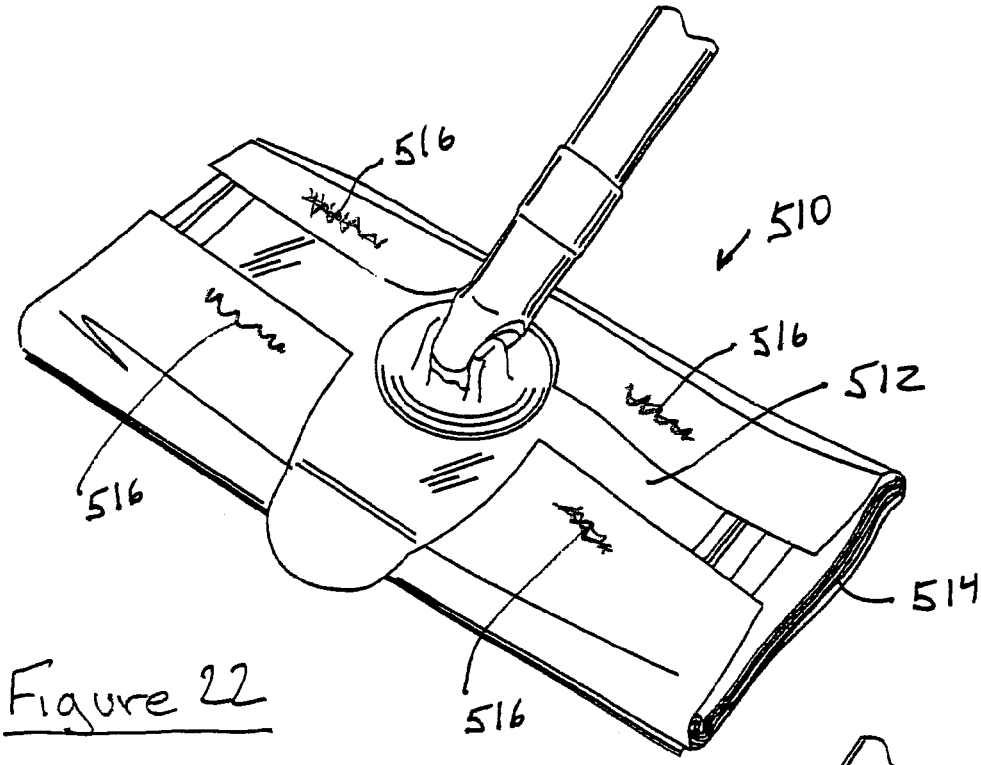
FIG. 22 s a perspective view of a mop head showing both edges of the refill attached to the mop head.

The mop 510 in FIG. 22 has a mop head 512 with a downwardly facing lower surface and an upwardly facing upward surface. In this embodiment, the mop head has grippers 516 provided on the upper surface of the mop head 512 designed to grip the edge of disposable cleaning sheets which are wrapped around the mop head 512. These cleaning sheets have a central section that is placed adjacent the lower surface of the mop head and side edges that wrap around the leading and trailing edges of the mop head and are gripped by the grippers. One or more cleaning sheets 514 form a refill with leading and trailing edges that wrap around the mop head 512, with the edges shown being gripped at four positions 516. As will be clear to those of skill in the art, other types of refills or cleaning sheets may also be attached to the mop head 512, and other types of grippers may be used, such as clamps, tabs, or other approaches. Releasable adhesives may also be used.

FIG. 23 shows a cross-sectional view of the mop head 512 with a single cleaning sheet 520 wrapped around the mop head and having its edges tucked into grippers 516. In the illustrated embodiment, the cleaning sheet has a central cleaning layer 522 that is sized to cover the lower surface 524 of the mop head 512 and a plastic layer 526 that extends beyond the cleaning layer 522 and wraps around the mop head so as to be engaged by the grippers 516.

In other embodiments, a mop refill can be provided with multiple cleaning sheets, with an outer sheet being peelable so as to remove it from the remainder of the refill, when the outer sheet becomes soiled. These sheets may be designed for dusting or mopping (i.e. dry or wet use). According to the present invention, a refill is provided that has a dusting layer removably supported on a mopping layer.

Figure 24:
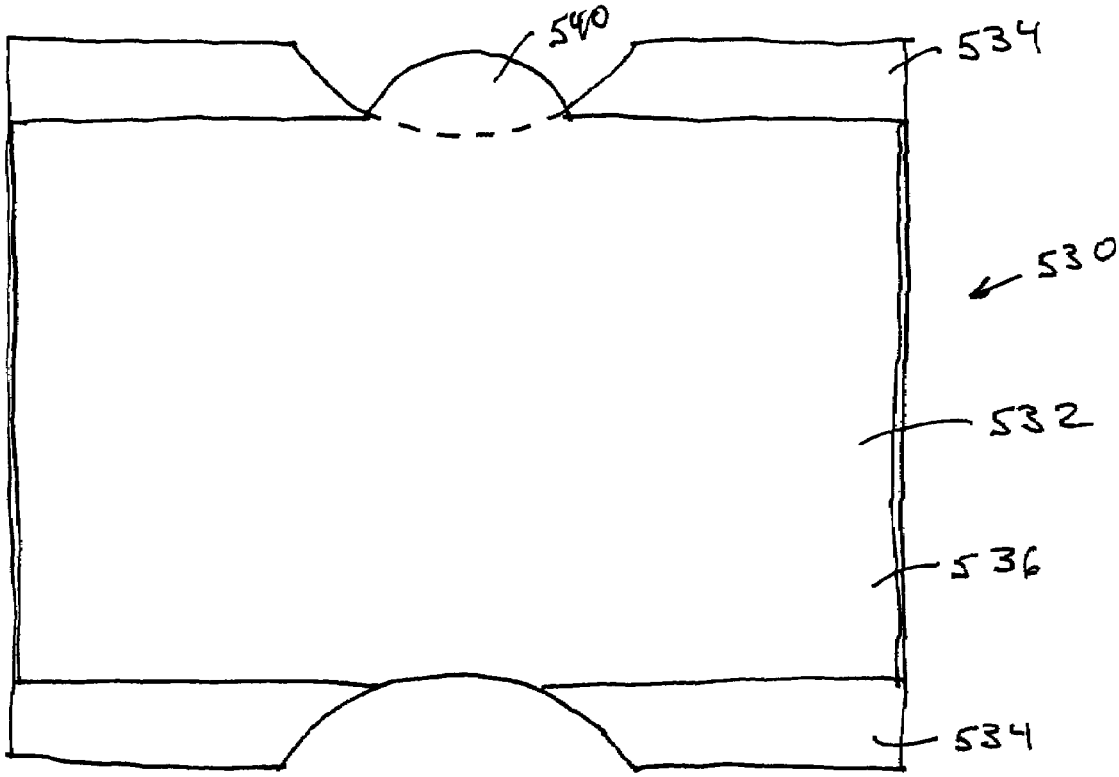
FIG. 24 is a plan view of a refill for a mop according to the present invention.
Figure 25:
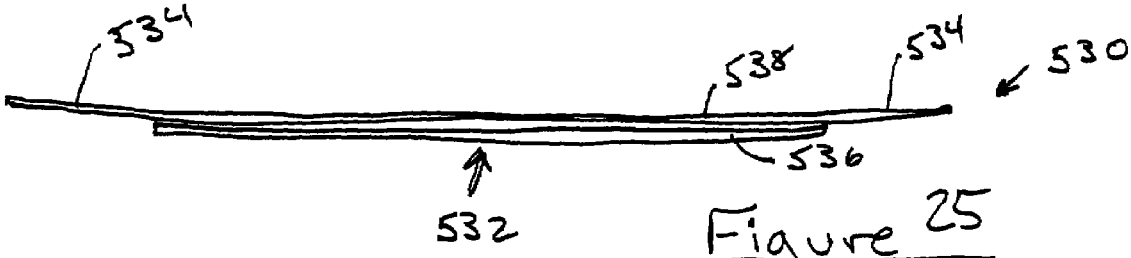
FIG. 25 is an end view of an alternative embodiment of a mop refill.

Such a refill is illustrated at 530 in FIGS. 24 and 25. The refill 530 has a central portion 532 that is positioned adjacent the lower surface of a mop such as shown in FIGS. 22 and 23, and edge portions or wings 534 that wrap around the mop head and are attached using some type of gripper. In this embodiment, the refill 530 has a lower sheet 536 and an upper sheet 538. In one preferred embodiment, the lower sheet 536 is a dusting material, such as a non-woven fabric, or the fabrics used in Swiffer® or Grabbit® dusting refills. This lower sheet 536 is releasably bonded to the upper sheet 538, which is a mopping sheet. This mopping sheet 538 may take the form of any of the various mop refill mopping sheets, such as the Clorox™ Ready Mop™ mopping sheets, or the mopping sheets designed for competing systems. These sheets are typically multi-layer, and have high absorbency so as to absorb and retain a cleaning fluid. A lower sheet 536 may be bonded to the upper sheet 538 using a releasable adhesive, or in using other approaches, as will be described herein below. In the illustrated embodiment, the lower sheet 536 has a tab 540 extending from one side that may be gripped to peel away the dusting sheet 536.

Figure 26:
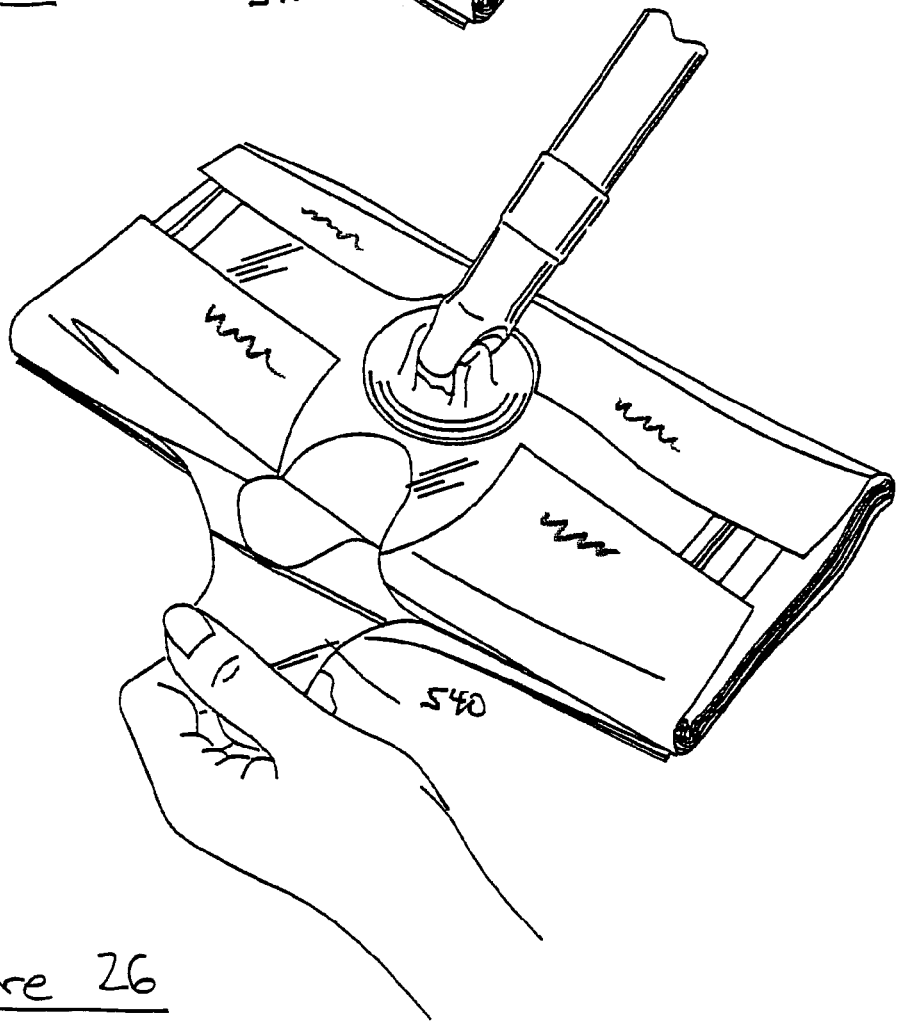
FIG. 26 is a perspective view of a mop head with a refill installed thereon, showing a soiled outer sheet being removed.

As will be clear to those skilled in the relevant art, the upper sheet 538 and lower sheet 536 may each be made with one or more layers. For example, the dusting sheet 536 may be a single layer of dusting material, or may have a backing reinforcement layer or waterproof layer. Likewise, the mopping sheet 538 may be a single layer or multiple layer. In use, the refill 530 is wrapped about the mop head and is then used such that the lower dusting sheet 536 is moved over a surface to be cleaned, thereby picking up dust and debris. The tab 540 is then gripped to peel the dusting sheet 536 off the mopping sheet 538 and is thrown away. While tab 540 is preferred to allow easy gripping, it is not required for the functioning of the present invention. As an alternative, an additional tab on the other edge may also be provided, or tabs in other positions. A tab on each edge is preferred in some applications, because it allows a user to grip both edges and peel them towards the center, thereby forming a taco-shape out of the soiled sheet, with the dirt and debris trapped inside. After the dusting sheet 536 is thrown away, the mopping sheet 538 is used, typically with a cleaning fluid, to mop the surface to be cleaned. FIG. 26 illustrates how tab 540 may be gripped to peel off the outer sheet.

Figure 27:
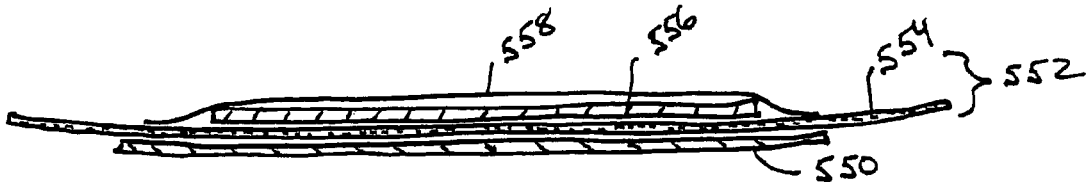
FIG. 27 is an end view of an alternative embodiment of a mop refill, having a dusting sheet and a multilayer mopping sheet.

Referring now to FIGS. 27-31, alternative arrangements of a mopping layer and a dusting layer will be described. In FIG. 27, a dusting sheet 550 is shown attached to the underside of a multi-layer mopping sheet 552. In this embodiment, the dusting sheet 550 is narrower than the mopping sheet 552, as in the embodiments of FIGS. 24-25.

Figure 28:
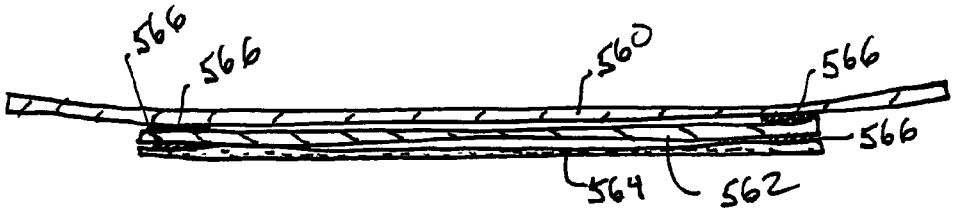
FIG. 28 is an end view of an alternative embodiment of a mop refill, having two dusting sheets.

The mopping sheet 552 has a lower cleaning layer 554 that allows moisture to pass therethrough. It may be a woven or non-woven fabric or fabric-like material and may have pores so as to pass liquid and trap particles. An absorbent layer 556 is provided above the cleaning layer 554 and is designed to absorb and retain cleaning fluids during the mopping process. This absorbent layer is narrower than the outer cleaning layer 554 so that it is disposed only on the underside of the mop head. A moisture barrier layer 558 covers the upper side of the absorbent layer 556 and extends beyond it so as to join the outer cleaning layer 554. This moisture barrier layer helps to keep liquid retained in the absorbent layer 556, not to pass out the upper side. The Clorox™ Ready Mop™ mopping sheets are formed in accordance with this description of the mopping sheet 552. FIG. 28 illustrates an alternative wherein a mopping sheet 560, which may be one or more layers, has two dusting sheets 562 and 564 releasably joined thereto. This embodiment recognizes that for some cleaning jobs, a single dusting sheet may be insufficient to clean the entire area which is to be mopped. Therefore, the outer dusting sheet may be used and disposed of, and then the inner sheet 562 used and then disposed of. Finally, the mopping sheet 560 is used. As shown, the dusting sheets 562 and 564 are releasably interconnected and joined to the mopping sheet 560 by a releasable adhesive 566. This same approach may be used with the earlier embodiments. This releasable adhesive may be an actual applied adhesive, or may take the form of light heat bonding, pressure bonding, ultrasonic bonding, etc. between the layers, such that they are separable when peeled away. The releasable adhesive or other bonding may also cover a larger portion of the interconnecting area, such as the entire back surface of one of the dusting sheets, so as to securely attach it to the dusting sheet above it. The adhesive should preferably be chosen such that it leaves little or no residue on the sheet from which it separates.

Figure 29:
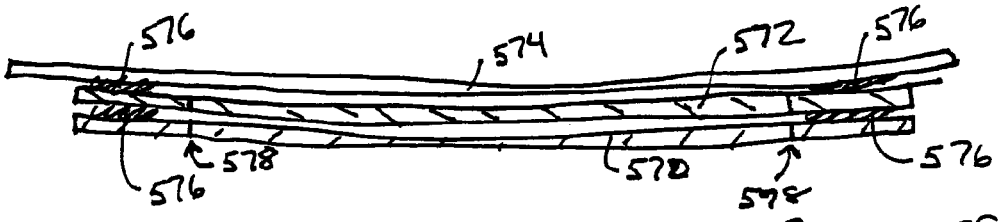
FIG. 29 is an end view of an alternative embodiment of a mop refill, having two interconnected dusting sheets.

Referring now to FIG. 29, a pair of dusting sheets 570 and 572 are shown attached to a mopping sheet 574. In this embodiment, the sheets 570-572 are interconnected using a bond, such as adhesive, melt bonding, or sewing, as generally indicated in 576. The removable sheets 570 and 572 are then serrated or otherwise weakened, such as shown at lines 578 so that an outer sheet, such as 570, can be torn away from the remainder of the refill. This forms an alternative to a releasable adhesive. FIG. 29 also illustrates that the mopping layer 574 is wider than the dusting sheets 570 and 572, such that the mopping sheet 574 is engaged by the grippers, but the dusting sheets 570 and 572 are not.

The embodiments of FIGS. 28 and 29 may be provided with a single dusting sheet or with three or more dusting sheets, depending on the application.

Figure 30:
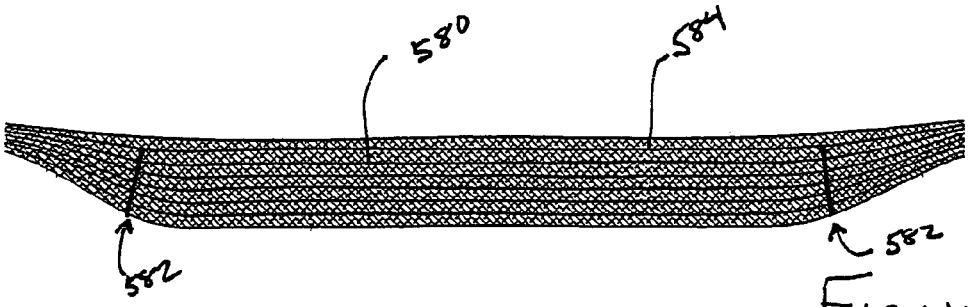
FIG. 30 is an end view of an alternative embodiment of a mop refill, having multiple co-extensive sheets.

FIG. 30 shows yet another alternative, wherein multiple sheets are all coextensive and the edges are interconnected such as by heat bonding. Each of the sheets 580 has a weakened or serrated area at 582 so that the mid-portion may become separated as it becomes soiled. As with earlier embodiments, the embodiment of FIG. 30 has a top mopping sheet 584 and one or more dusting sheets 580 that are removed so as to expose the mopping sheet 584.

Figure 31:
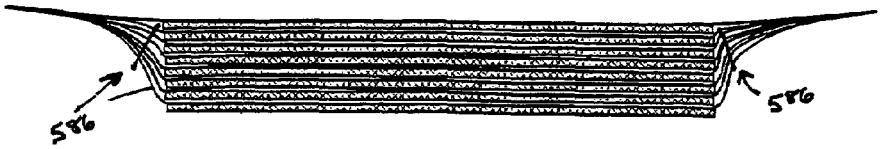
FIG. 31 is an end view of an alternative embodiment of a mop refill, having multiple sheets each having a backing layer.

FIG. 31 shows yet a further embodiment wherein multiple sheets each have a backing layer that extends beyond the central portion with the edges of the reinforcement layer being engaged by the gripping means on the mop head. Again, the upper sheet may be a mopping sheet, while the remaining sheets are dusting sheets. This embodiment may have one or more dusting sheets. The reinforcement layers are weakened or serrated at lines 586.

Figure 32:
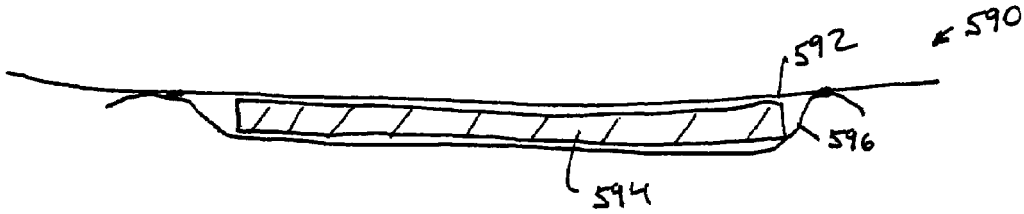
FIG. 32 is an end view of an alternative embodiment of a mop refill, having a pre-moistened sheet.
Figure 33:
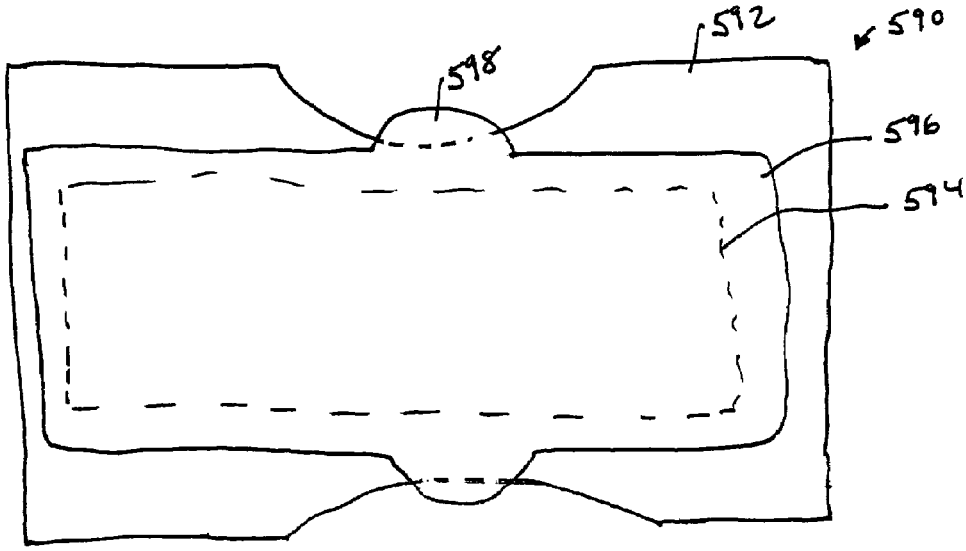
FIG. 33 is a plan view of an alternative embodiment of a mop refill, having a pre-moistened sheet.

Referring now to FIGS. 32 and 33, a pre-moistened cleaning or waxing sheet 590 will be discussed. For some applications, it is desirable to provide a pre-moistened sheet so as to allow the easy application of cleaning solutions or waxes or polishes to a surface. The cleaning sheet 590 preferably has a moisture barrier backing layer 592 with an absorbent layer 594 attached thereto. As shown, the absorbent layer 594 is preferably smaller than the backing layer 592 such that it is disposed only on the lower surface of the mop head, or portion thereof. This absorbent layer 594 is preferably pretreated with a cleaning solution, a wax, a polish, or other treatment materials. Preferably, the pre-moistened layer 594 is sufficiently sealed such that it does not dry out or leak prior to use. For this purpose, a removable sealing layer 596 is provided. The sealing layer 596 covers the absorbent layer 594 and is sealed to the backing layer 592 around all edges of the absorbent layer 594, so that it is sealed in a pocket. When a consumer wishes to use the pre-moistened layer, it is first attached to the mop head using the edges of the backing layer 592, and then the sealing layer 596 is removed, such as by gripping tabs 598. The sealing layer 596 may be attached using a releasable adhesive, so that it can be peeled away, or may have serrations or weakened portions so that it tears away. The pre-moistened absorbent layer 594 may then be placed against the surface to be cleaned so as to apply the solution in the pre-moistened layer onto the surface.

The embodiments of FIGS. 32 and 33 are referred to herein as a pre-moistened sheet, and may form part of a larger refill, as will be described herein below. Alternatives on the embodiment of FIGS. 32 and 33 include pre-moistened layers that are different sizes and shapes, such as a plurality of individual strips that are spaced apart on the backing layer. The sealing layer may extend co-extensive with the backing layer or may form the portion that engages the grippers with only a central portion of the sealing layer being peeled or torn away.

Figure 34:
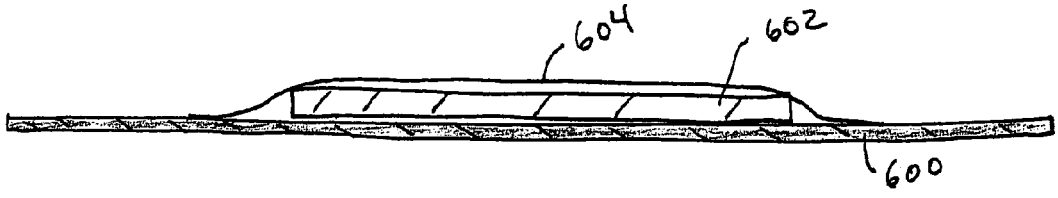
FIG. 34 is an end view of an alternative embodiment of a mop refill, having a lower cleaning layer.
Figure 35:
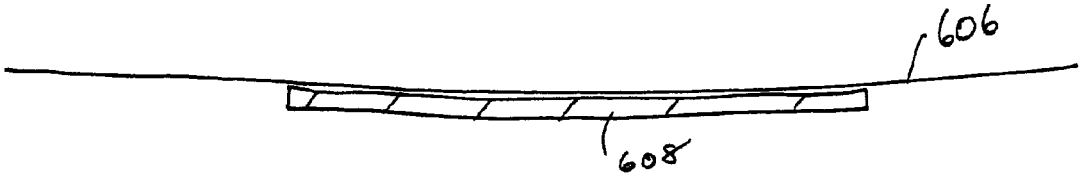
FIG. 35 is an end view of an alternative embodiment of a mop refill, having a backing layer sized to be gripped by a mop head.
Figure 36:
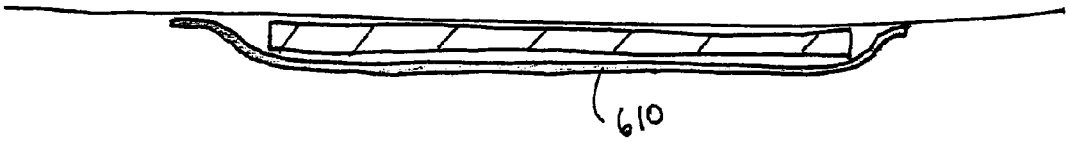
FIG. 36 is an end view of an alternative embodiment of a mop refill, having an outer cleaning layer.

Referring now to FIGS. 34-36, various embodiments of a mopping sheet will be described. Mopping sheets differ from pre-moistened sheets in that they are initially dry and designed to absorb liquid that is applied from another source.

FIG. 34 illustrates the cleaning sheet of the same design as in FIG. 27, having a lower cleaning layer (such as a mopping sheet) 600 that allows moisture to pass through it, an absorbent layer 602 positioned above the cleaning layer 600, and a backing or sealing layer 604 that covers the backside of the absorbent layer 602 and helps to join it to the cleaning layer 600. Alternatives include that the backing layer 604 may be coextensive with the cleaning layer 600. Another alternative is that the backing layer, which may be a moisture barrier layer, may extend so as to be engaged by the grippers, with the cleaning layer 600 being smaller. The absorbent layer 602 may also be larger or even coextensive with the cleaning layer or backing layer.

The mopping sheet embodiment of FIG. 35 has a backing layer 606 that is sized to wrap around the mop head and be engaged by the grippers, and an absorbent cleaning layer 608 that is positioned just on the mid-portion of the backing layer 606. The layer 608 preferably is absorbent and acts as a cleaning layer.

The embodiment of FIG. 36 is similar to the embodiment of FIG. 35, but adds an outer cleaning layer 610. In each of the embodiments of FIGS. 35 and 36, the absorbent layer may be coextensive with the backing layer, and the backing layer may be a moisture barrier layer, or merely a support and strengthening layer. As a further alternative, a mopping sheet may consist of a single absorbent cleaning layer without backing layers or additional absorbent layers or cleaning layers.

Figure 37:
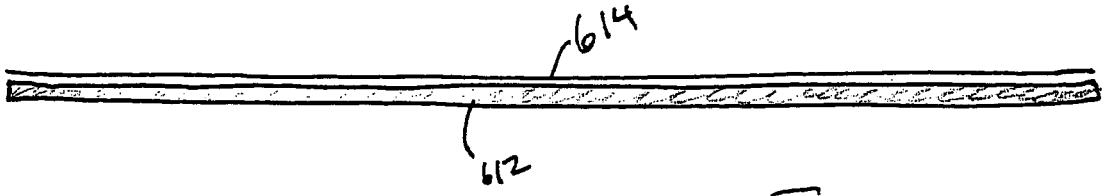
FIG. 37 is an end view of a dusting sheet having coextensive cleaning and backing layers.
Figure 38:
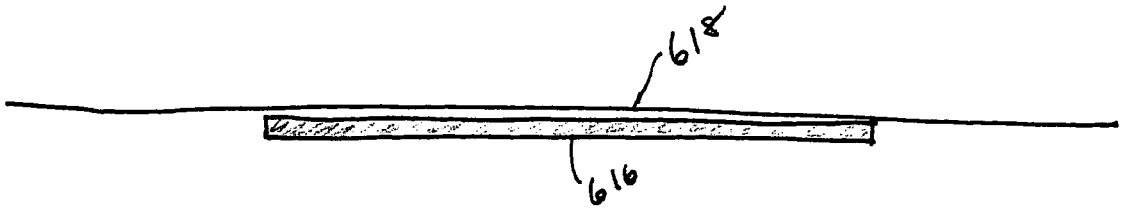
FIG. 38 is an end view of a dusting sheet, having a cleaning layer smaller than a backing layer.
Figure 39:
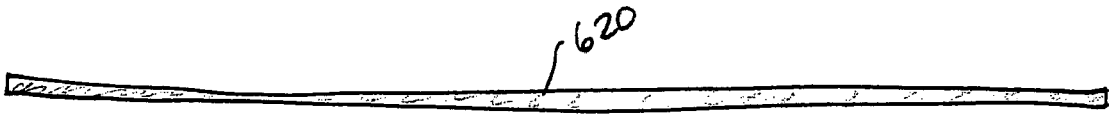
FIG. 39 is an end view of a single layer dusting sheet.

Referring now to FIGS. 37-39, various embodiments of the dusting sheet will be described. Dusting sheets differ from pre-moistened sheets and mopping sheets in that they are designed to remain dry and to pick-up dust and debris such as through static cling or tackiness or other dry contact approaches. FIG. 37 illustrates a dusting sheet that has a coextensive cleaning layer 612 and backing layer 614. This is similar to the embodiments discussed in the incorporated documents. FIG. 38 presents an alternative wherein the cleaning layer 616 is smaller than the backing layer 618, and FIG. 39 presents a dusting sheet that is just a single layer 620.

Any of the dusting sheet approaches discussed in the incorporated documents may be used as a dusting sheet herein. Also, the materials of the cleaning layer 612, 616, and 620 may be reinforced with a scrim and be scrunched, texturized, or have pores for trapping debris. It may also be partially or completely coated with a tackifier for retaining debris. The dusting sheet may be absorptive or hydrophobic, or somewhere between. It may have a natural static cling characteristic, or may be treated so as to achieve a static cling. It also may be pretreated with a polishing agent or dusting agent. The backing layer 614, 618 may be a moisture barrier layer, or may merely be a strengthening layer.

The above-discussed embodiments of pre-moistened sheets, mopping sheets, dusting sheets may be combined in various configurations so as to provide refills with removable outer layers.

FIGS. 40-51 present various combinations of cleaning sheets. For each alternative combination, the sheets may be coextensive, or upper sheets or lower sheets may instead of being trapped by the grippers, with other sheets being smaller. Also, the sheets may be interconnected by any of the previously discussed approaches, such as releasable adhesive, weakened, or serrated areas, use of tabs, etc. Also, any of the interconnection approaches discussed in the incorporated documents, such as heat-bonded edges compressed for engagement by the grippers, may be used in the combinations of FIGS. 40-51. In each case, a mopping sheet, a pre-moistened sheet, or a dusting sheet, may take any of the forms previously discussed or provided for in the incorporated documents.

Figure 40:
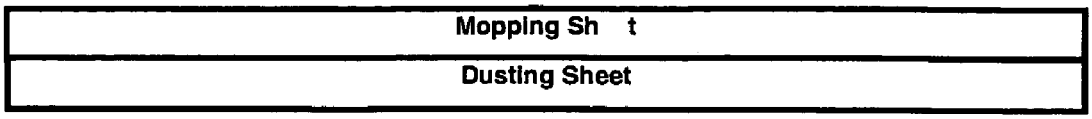

FIG. 40 presents a simple embodiment similar to FIG. 27, wherein a mopping layer and dusting layer are combined. In this case, the dusting layer is first used to remove dust and debris, and is then removed and disposed of. The mopping layer is then used with a cleaning solution to clean the floor.

Figure 41:
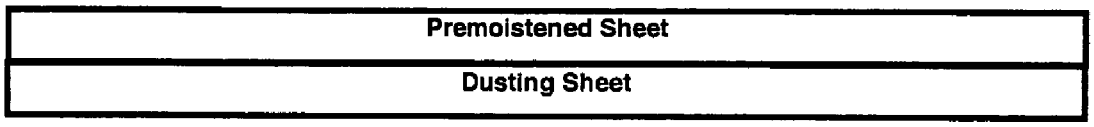

FIG. 41 presents an alternative wherein a dusting layer and a pre-moistened layer are combined. In this case, the dusting layer may be used to pick-up dust and debris and then be removed. The pre-moistened layer is then preferably unsealed, by removing a sealing layer, and is used to apply a solution to the floor. In this case, the pre-moistened sheet may be treated with a cleaning compound. As one preferred alternative, the dusting layer has a moisture barrier backing layer that acts to seal in the pre-moistened portion of the pre-moistened sheet. In this way, when the dusting sheet is peeled away, the pre-moistened sheet becomes ready for use.

Figure 42:
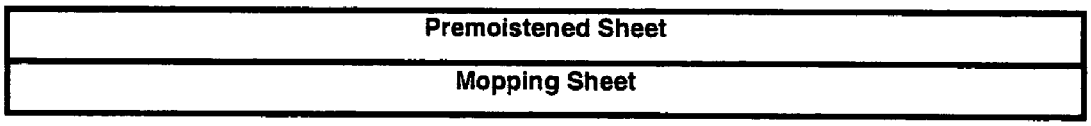

Referring now to FIG. 42, an alternative including a pre-moistened sheet and an mopping sheet is illustrated. Again, as with all embodiments herein, the sheets may be co-extensive or not co-extensive, and may be interconnected using any of the disclosed approaches. In this version, the mopping layer would first be used with a cleaning solution to clean a floor. It may be then be peeled away so as to expose the pre-moistened sheet. Preferably, the peeling away of the mopping layer also exposes the portion of the pre-moistened sheet so that it is ready to use. As an example, the mopping sheet may have a moisture layer backing layer that seals in the pre-moistened portion of the pre-moistened sheet. In this case, the pre-moistened sheet would typically include a solution for further cleaning or for waxing or polishing to follow the cleaning step.

Figure 43:
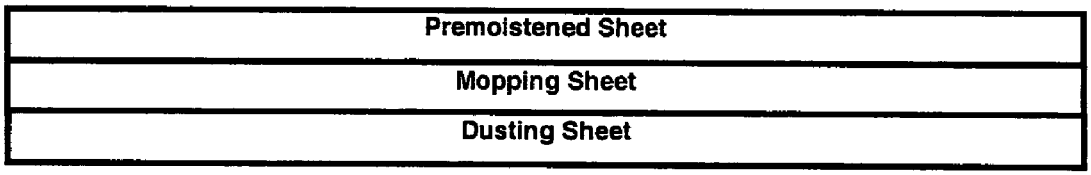

FIG. 43 presents a version having a pre-moistened sheet, a mopping sheet, and a dusting sheet, in that order. For this embodiment, the dusting sheet can first be used to remove dust and debris, then the mopping sheet can be used to mop, and the pre-moistened sheet may be used to mop, and the pre-moistened sheet may be used to wax or polish, or further clean.

Figure 44:
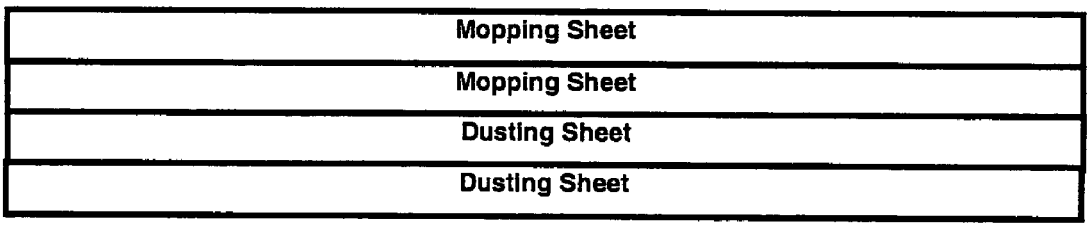
Figure 49:
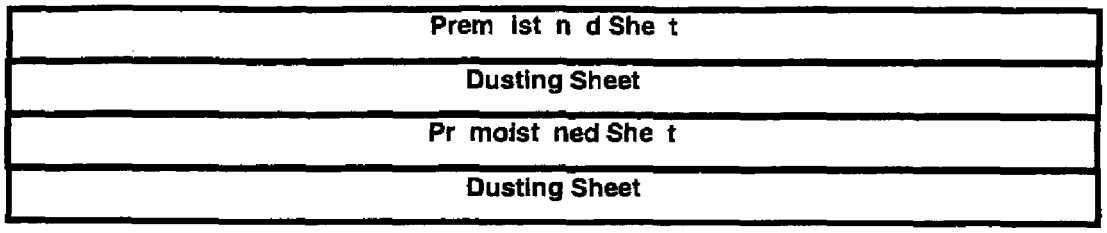
Figure 50:
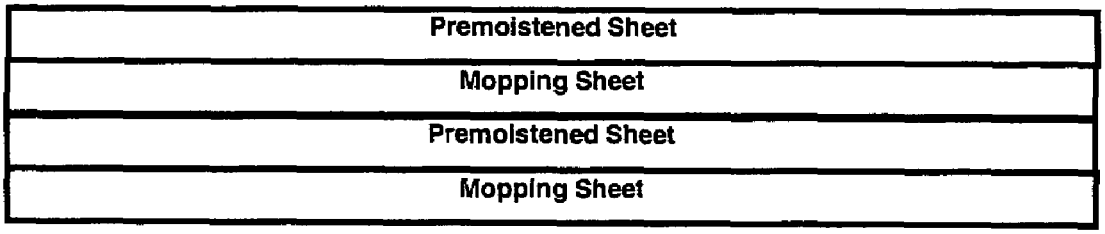

FIG. 44 presents a version having two mopping sheets and then two dusting sheets. It is envisioned that some floors are sufficiently large that a single dusting sheet and a single mopping sheet are insufficient for cleaning the entire floor. In this embodiment, one dusting sheet may be used until soiled, and then the second dusting sheet used to finish the job. Likewise, the first mopping sheet may be used until soiled, and then removed to expose the second mopping sheet. In this embodiment, it is preferred that the first mopping sheet be separated from the second mopping sheet by a moisture barrier layer to avoid contamination of the uppermost mopping sheet when using the lower mopping sheet. As alternatives, any number of mopping sheets and any number of dusting sheets may be provided. For example, testing of certain versions may suggest that dusting sheets are only good for about half as much area as a mopping sheet. Therefore, the ratio between the dusting sheets and mopping sheets may preferably 2:1. Alternatively, the ratio may be reversed, or may be any other ratio. The preferred embodiment depends on customer preferences.

FIG. 45 presents an alternative embodiment wherein a mopping sheet is provided as an uppermost sheet, and then two precleaning sheets are provided, and then a dusting sheet as the lowermost sheet. As with previous embodiments, the dusting sheet can first be used to remove dust from the floor. The precleaning sheets are cleaning sheets that allow moisture to pass of therethrough to the mopping sheet. Depending on the floor type and the amount dirt and debris, it may be desirable to essentially change the outer layer of the mopping sheet. This embodiment provides this effect. After the dusting sheet is removed, the remaining sheets form an essentially thick mopping sheet with the outermost layer being removable. The floor is wetted with a cleaning solution and then cleaned using the remaining three sheets. As the outer sheet becomes soiled, it may be removed to expose an additional precleaning sheet to pick-up more dirt and debris. As this becomes soiled, it may also be removed to expose the final mopping sheet. In an alternative embodiment, a dusting sheet is not provided, or more dusting sheets are provided. Also, any number of precleaning sheets may be provided over the top of the single mopping sheet. Preferably, only the mopping sheet would have the absorbent layer, such that liquid would pass through the precleaning sheets to this absorbent layer. The precleaning sheets may take the form of a dusting sheet that tolerates liquid, though without any kind of moisture barrier layer. It may be of a material such as a spun-bonded or spun lace non-woven fabric as is used in Swiffer® or Grabbit® cleaning sheets and may have a reinforcement scrim. Alternatively, it may be formed similar to the outermost layer of a mopping sheet such as the Clorox™ Ready Mop™ mopping sheet. Such an outer layer has coarser fibers with open pores for passing and capturing debris.

The precleaning sheets and the mopping sheet may also have different outer surface characteristics from each other. For example, the outermost precleaning sheet may have a coarse outer surface designed for scrubbing. In this case, the dirtiest portions of the floor would first be scrubbed with this outer layer. It can then be removed so as to expose the second precleaning sheet, which may be softer. Each precleaning sheet and the mopping sheet may be different so as to allow for different types and stages of cleaning. If a user does not require a certain layer, it can be removed without using it.

Referring now to FIG. 46, a plurality of pre-moistened sheets may be provided in a stack. Preferably, each pre-moistened sheet has a pre-moistened portion that is sealed until use. The outermost pre-moistened sheet may have a sealing layer that is peeled away to expose the pre-moistened portion. Then, as each soiled pre-moistened sheet is peeled away, the pre-moistened portion of the next pre-moistened sheet may be exposed and ready for use. These pre-moistened portions may be trapped between layers of moisture barrier material that are sealed with a releasable adhesive or tear-away portion. This embodiment allows a larger area to be cleaned or waxed with pre-moistened sheets without having to change the entire refill.

FIG. 47 presents an embodiment having multiple mopping sheets. Again, it is preferred that the individual mopping sheets are separated by a moisture barrier layer so that soiling of the outer sheet does not soil the upper sheets.

Figure 51:
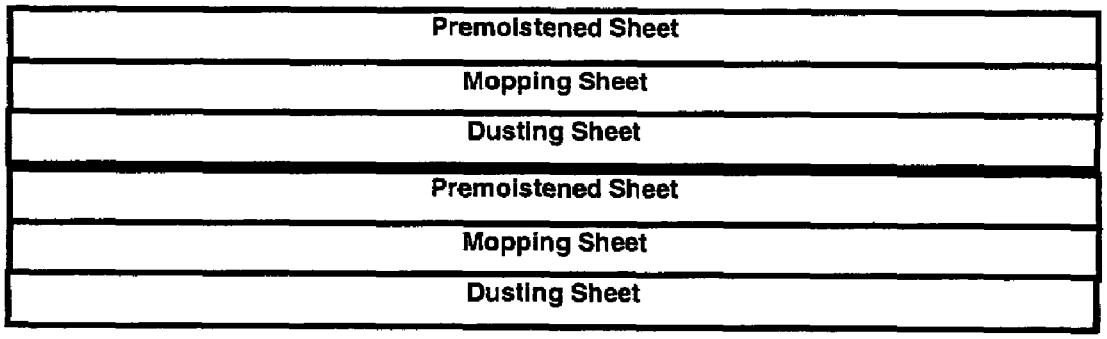

FIG. 48 presents a doubled version of the embodiment of FIG. 40. That is, it has a mopping sheet, then a dusting sheet, then a mopping sheet, then a dusting sheet. This is to illustrate that any of the herein discussed embodiments may be altered by increasing any of the layers, or repeating layers in any order. For example, FIG. 49 offers a doubled version of the embodiment of FIG. 41, while the embodiment of FIG. 50 offers a doubled version of the embodiment of FIG. 42. FIG. 51 presents a doubled version of the embodiment of FIG. 43. These embodiments may instead be tripled or quadrupled or any other number that is functional so as to create a refill that has longer utility.

As additional embodiments or variations on any of the embodiments of the present invention disclosed throughout this specification, the cleaning sheets may be provided with a static charge to increase dust collection. As another alternative, the cleaning sheet and/or the backing layer may be given a wrinkled finish so as to improve the pickup of debris. For example, the backing layer may be stretched and then released to create a crinkled appearance.

As an additional embodiment, a stack of unattached cleaning sheets could be wrapped around a dispensing mop head, whereby a plastic lid or cover is snapped onto the top portion of the sweeper tool/mop head with the tabs and perforations remaining outside of the sweeper lid, thus providing a tear-off mechanism.

ADDITIONAL EMBODIMENTS

It can be advantageous to remove loose dust from a surface before wiping the surface with a damp cloth, to prevent smearing and scratching the surface. Hence, an improved method of cleaning a surface includes providing a cleaning tool, providing a cleaning sheet having a dusting sheet and a mopping sheet, securing the cleaning sheet to the cleaning tool to expose the dusting sheet, wiping the dry surface with the dusting sheet, to pick up dust from the surface, at least partially detaching the dusting sheet to expose the mopping area of the mopping sheet, and wiping the surface with the mopping area of the mopping sheet. The cleaning tool can be a mop having a mop head, a mitt, or other apparatus designed to facilitate cleaning the surface.

Figure 52A:
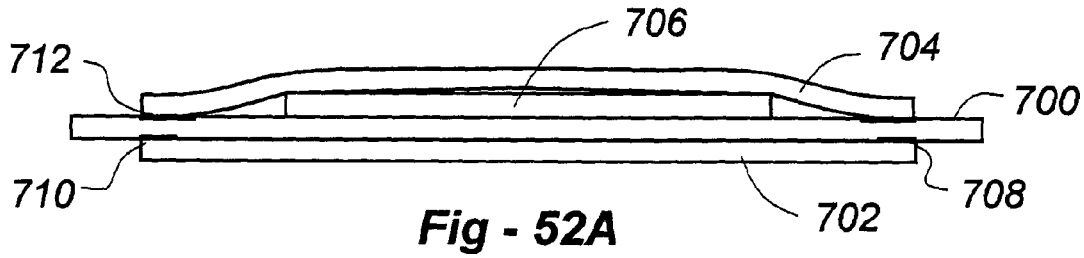
FIGS. 52A-C show a cleaning sheet having a mopping sheet and a dusting sheet.

FIG. 52A shows a side view of a multi-layer cleaning sheet according to an embodiment of the present invention, and suitable for use as a mop refill. As shown in FIG. 52A, the cleaning sheet includes a mopping sheet having an upper side and a lower side. The terms upper and lower are used here for convenience, and are not limiting. This orientation corresponds to the orientation of the cleaning sheet when secured to a mop head used to mop a floor. A dusting sheet 702 is attached to the lower side of the mopping sheet. A backing layer 704 is attached to the upper side of the mopping sheet 700. A water absorbing layer 706 is in contact with the upper side of the mopping sheet, and held in approximate position by the backing layer.

Figure 52B:
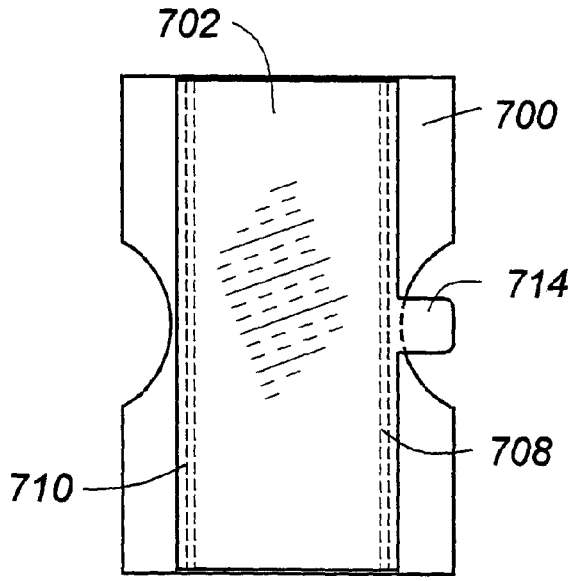

FIG. 52B shows a view of the lower side of the mopping sheet 700, showing a generally rectangular dusting sheet attached to the mopping sheet along dusting sheet attachment regions 708 and 710, located along the two opposed long edges of the dusting sheet. In other embodiments, the dusting sheet may be attached along opposed short edges, or along three or four edges. The dusting sheet further includes a tab 714 that is not attached to the mopping sheet, and pulling on the tab facilitates removal of the dusting sheet from the lower surface of the mopping sheet.

Figure 52C:
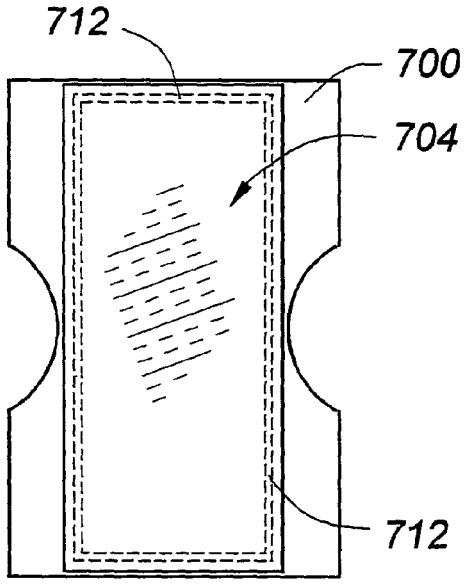

FIG. 52C shows a top view of the cleaning sheet, showing the generally rectangular backing layer 704 attached to the mopping sheet along a backing layer attachment region 712 that extends around the periphery of the backing layer. A pocket is formed between the backing layer and the mopping sheet that is used to hold the water impermeable layer. In other embodiments, the backing layer may be attached along opposed edges, or along 3 edges. For clarity, the dusting sheet tab 714 is not shown in this view.

Figure 53A:
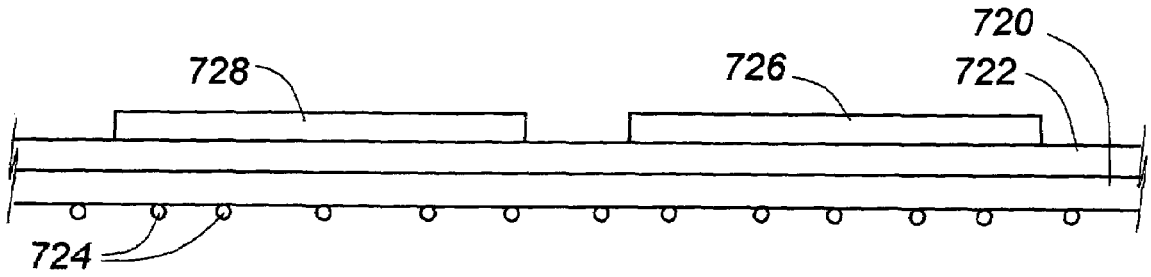
FIGS. 53A-B show a cleaning sheet having a mopping sheet and a dusting sheet having a tab.
Figure 53B:
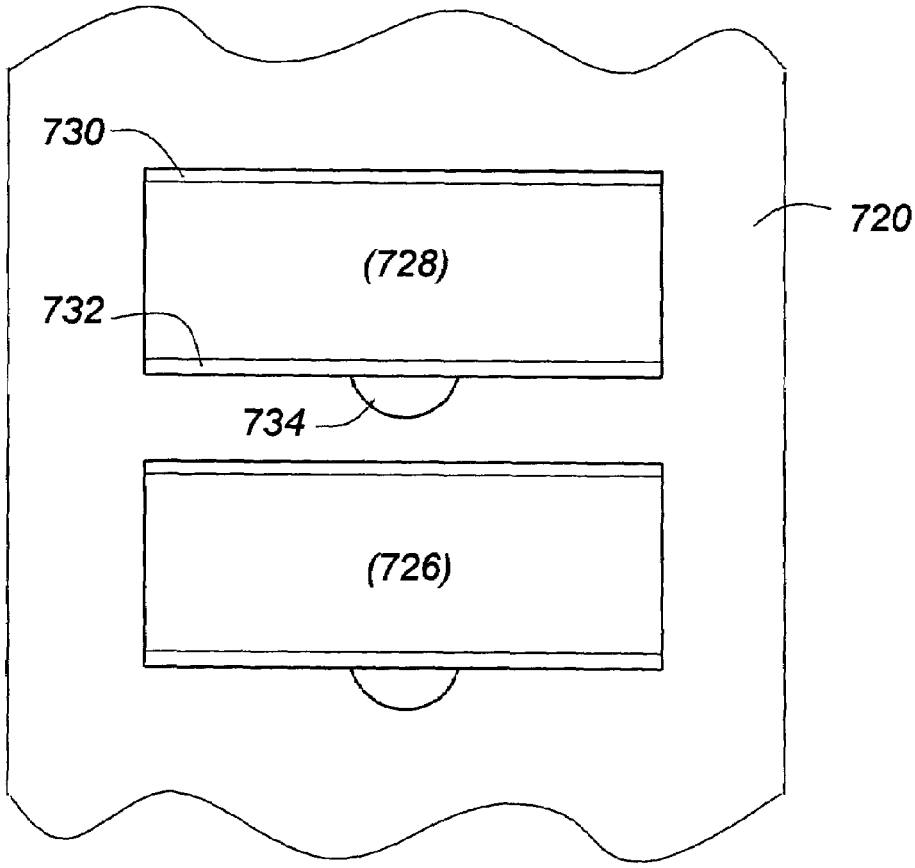

FIG. 53A shows a side view of part of a multi-layer cleaning sheet, comprising a backing layer 720, a mopping sheet 722, adhesive droplets 724, and removable dusting sheets 726 and 728. The cleaning sheet can be used as a mop refill in a similar manner to that of the cleaning sheet illustrated in FIG. 3 and discussed in more detail above. FIG. 53B shows a top view of the cleaning sheet, showing a dusting sheet having a tab 734, and attached to the mopping sheet using attachment areas 730 and 732. It should be noted that in all cases a tab for grabbing a sheet may be integral with or separate and attached to the sheet. Also, in all cases, one or two tabs, no tabs, or more than one tab may be provided on one or more sheets in a refill.

Figure 54:
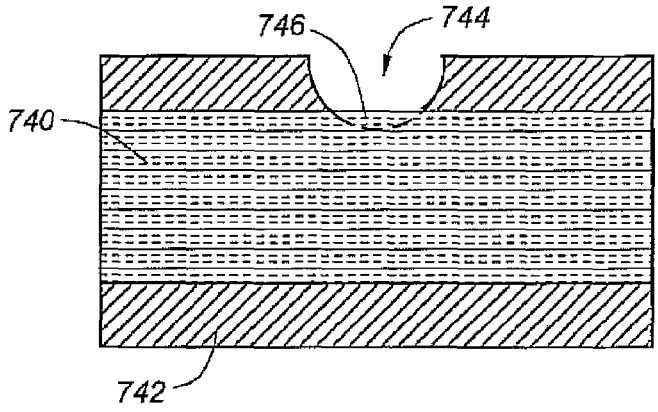
FIG. 54 shows a cleaning sheet having a mopping sheet and a dusting sheet, the mopping sheet having a cut out.

FIG. 54 shows a further embodiment of a cleaning sheet, having a dusting sheet 740 attached to a mopping sheet 742. The mopping sheet and dusting sheet are both generally rectangular, with the short sides approximately in register and the long sides approximately parallel. The dusting sheet covers a substantial portion of one side of the mopping sheet, so that detaching the dusting sheet exposes that portion of the mopping sheet. The mopping sheet has a radius cut out 744 which extends into the mopping sheet to allow a portion of the dusting sheet, at 746 near the edge of the dusting sheet, to be easily grasped, to facilitate removal of the dusting sheet.

In other embodiments, the dusting sheet can extend beyond the side (short) edges of the mopping sheet. The edge of the dusting sheet need not be straight, and can for example have a wavy edge providing one or more convenient tabs for removal of the dusting sheet.

Another embodiment has a second radius cut out from the opposing edge of the mopping sheet. The portions of the mopping sheet not covered by the dusting sheet can act as tabs which can be gripped or otherwise secured by a mop head.

Figure 55:
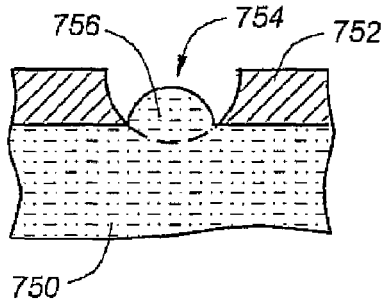
FIG. 55 shows a portion of a cleaning sheet in which the mopping sheet has a cut out and the dusting sheet has a tab.

FIG. 55 shows a portion of another embodiment of a cleaning sheet including a dusting sheet 750 and a mopping sheet 752. A radius cut out 754 from the edge of the mopping sheet facilitates grasping the edge of the dusting sheet, facilitating its removal. The dusting sheet 750 has a tab 756, with an opposite or opposed radius. The tab acts as a pull tab on the dusting sheet, and is approximately aligned with the radius cut out. This configuration can be used on one or both of the opposed edges of the dusting sheet.

Figure 56:
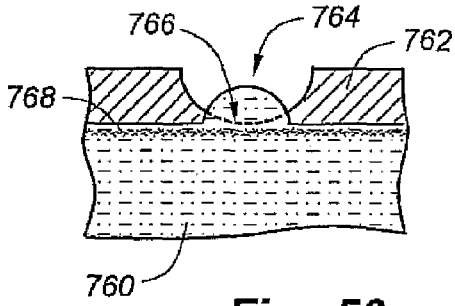
FIG. 56 also shows a portion of a cleaning sheet in which the mopping sheet has a cut out and the dusting sheet has a tab.

FIG. 56 shows part of another embodiment of a cleaning sheet having a dusting sheet 760 and a mopping sheet 762. The mopping sheet has a cut out 764 approximately aligned with a tab 766 on the dusting sheet. A glue line 768 extends along the edge of the dusting sheet. For manufacturing convenience, a straight continuous glue line can be advantageous. However, in other embodiments, the glue line can be broken into portions near the edge of the dusting sheet.

The second opposed long side of the dusting sheet is not shown in FIG. 56. The structure of the illustrated side can be repeated on the opposed side, or the opposed side of the sheet may be straight or otherwise shaped.

A number of cleaning sheets can be produced in a roll. For example, a roll of such cleaning sheets can be, for example, separated by perforations along the short sides of each sheet. Continuous machine production of such rolls is straightforward.

Figure 57:
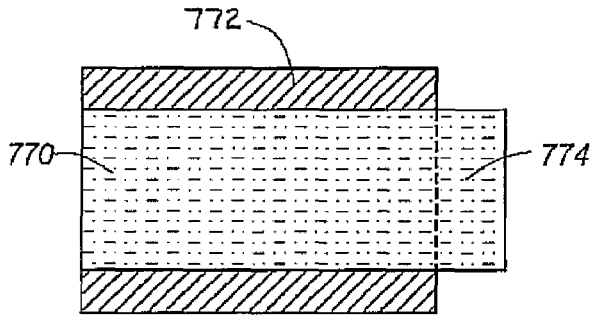
FIG. 57 shows a cleaning sheet in which the dusting sheet extends outwards over a short edge of a rectangular mopping sheet.

FIG. 57 shows a cleaning sheet having a dusting sheet 770 and a mopping sheet 772. A portion 774 of the dusting sheet extends outwards over the short edge of the mopping sheet to form a tab by which the dusting sheet can be grasped and removed. Tabs or similar portions of the dusting sheet can be positioned so as not to contact the surface when the dusting sheet is used, so that the tab remains clean. For example, a tab may partially wrap around a mop head so as to be out of the plane of the lower surface of the mop head.

In other embodiments, the dusting sheet may extend outwards over a long edge of the mopping sheet, for example, to provide a loose flap. A loose flap may be provided on the forward side and/or rear side of the cleaning sheet. The terms forward and rear are used in relation to a cleaning sheet attached to a mop head, for example as discussed in relation to the refill of FIG. 18. Loose dusting flaps may also be provided with respect to other embodiments, such as mitts.

For example, the dusting sheet can include a woven or non-woven web of hydrophobic fibers. As is generally accepted in the art, a material having a contact angle with water (in air) of over 90 degrees is hydrophobic. The hydrophobic fiber may be nylon, polypropylene, polyethylene, a polyester such as polyethylene terephthalate, fluoropolymer, or other polymer. The dusting layer preferably includes a substantial proportion of hydrophobic material by weight, for example at least 50%, 60%, 70%, 80%, 90%, or 95%, or 100% hydrophobic material.

The dusting sheet can include a non-woven sheet of entangled hydrophobic fibers such as polyethylene terephthalate. A scrim can be used to strengthen the dusting sheet, for example a square or rectangular grid of fibers.

In another embodiment, the dusting sheet can be formed from hydrophilic fibers, or a mixture of hydrophobic and hydrophilic fibers. The dusting sheet can also be a woven sheet, a sheet having a nap (such as a flocked sheet), chamois or simulated chamois, or some other form.

The dusting sheet may be provided with adhesive on the side used for dusting a surface, for example, to facilitate removal of larger particles. Alternatively, the dusting sheet may be partially or completely formed of fibers that are naturally tacky or treated to be tacky. In other embodiments, first and second dusting sheets may be provided. The first dusting sheet can be used to pick up dust, followed by a second dusting, followed by a mopping. The first dusting sheet may have a coarser weave than the second dusting sheet, to facilitate picking up of larger particles.

The mopping sheet is preferably water absorbent, and can be a non-woven web of water absorbent material. Water absorbent materials include rayon, cellulistic fibers (such as wood pulp fibers or fluff), water absorbing gels, and the like. The mopping sheet preferably includes a substantial proportion of water absorbing materials by weight, for example at least 50%, 60%, 70%, 80%, 90%, 95% or 100% water absorbing or hydrophilic material. As is known in the art, water absorbing materials also include naturally hydrophobic fibers having a surface treatment of hydrophilic surfactant, for example as described in U.S. Pat. No. 6,013,349 to Takeuchi et al.

The mopping sheet can also be a woven sheet, a foam pad, or formed from a mixture of hydrophobic and hydrophilic fibers. A mopping sheet may include a non-woven web of hydrophobic fibers supporting a water absorbing layer (as described below) in a unitary structure. A mopping sheet may also include one or more water impermeable layers, for example to help retain moisture in a pre-moistened sheet, or to prevent moisture reaching a dusting sheet.

The water absorbent layer can include one or more water absorbing materials, such as foam, water absorbing cloth, cellulistic fibers such as wood pulp, water absorbing gel, super-absorbing polymer, or the like. As is known in the art, super-absorbing polymers include polyethylene oxides, polyacrylates, polymethacrylates, polyacrylamides, polyvinyl alcohols, starches, gums, and the like, for example as described in U.S. Pat. No. 6,316,687, describing a diaper, to Davis et al. Super-absorbing polymers can be cross-linked, and may be included as fibers, particles, or in another form.

The backing layer can be a water impervious sheet, such as a moisture barrier layer. The backing layer may also be rigid, for example to facilitate sliding the backing layer into retaining structures on a cleaning tool. The backing layer can be a thin flexible plastic film, waxed paper, or other layer.

As previously discussed, a substantially square or rectangular dusting sheet can be attached to a mopping sheet through two attachment regions located along or proximate to two opposed edges. For use with an irregularly shaped dusting sheet, for example with certain embodiments of a cleaning mitt, attachment region can be around some or all of the periphery of the dusting sheet. Alternatively, the dusting sheet can be attached to the mopping sheet at a number of points or regions distributed over the area of the dusting sheet, or through a weak or releasable adhesive, for example in the form of dispersed adhesive particles, sprayed or otherwise disposed over some or all of the side of the dusting sheet.

Attachment of sheets to each other can be through any convenient method, for example using adhesive, pressure bonding, ultrasonic bonding, thermal bonding, radio-frequency bonding, sewing, hook and loop attachment (such as Velcro®), or other method. Adhesive particles may be dispersed over some or all of the upper side of the dusting sheet so as to attach it to the lower side of the mopping sheet.

Dusting sheets may be non-rectangular. For example, dusting sheets used with a mitt may be mitt-shaped, oval, or some other shape. The dusting sheet can be removably joined to a mopping sheet, and the mopping sheet removably attached to the mitt. For example, the dusting sheet may be joined around an outer peripheral region to the mopping sheet. The dusting sheet can be provided with one or more tabs, at convenient locations, which allow the dusting sheet to be removed or peeled back with gentle pulling on the tab.

As discussed previously, a cleaning sheet can be rolled around a mop head so as to expose a dusting sheet. A surface is wiped with a dry dusting sheet to pick up dust, then, after dusting, the dusting sheet is removed, and the area mopped using an area of the mopping sheet exposed when the dusting sheet is removed.

The mop head can be provided with grippers, clips, hooks and/or loops, or other mechanism to secure the cleaning sheet to the mop head. A cleaning sheet having a dusting sheet, mopping sheet, and/or backing layer can be secured by gripping the mopping sheet, the backing layer, or some combination of component sheets. After dusting a surface, the dusting sheet can be pulled away from the remainder of the cleaning sheet by pulling on the dusting sheet while holding the cleaning tool. For example, the dusting sheet can be provided with a tab to assist removal of the dusting sheet.

A cleaning sheet can be attached to a cleaning tool using any convenient method. For example, a cleaning sheet may have an elasticized periphery that grips part of a cleaning tool, such as a mop head. The cleaning tool may have hooks or loops, for example on a securely adhered pad, and complementary hooks or loops on the cleaning sheet adhere to the pad. The backing layer may have an adhesive thereon to secure the backing layer to the mop head. The backing layer may be rigid, for example a cardboard or plastic sheet, and slot into a suitably shaped portion of the cleaning tool. The backing layer may be omitted, and characteristics of the backing layer discussed elsewhere included in the mopping sheet. For example, a mopping sheet may have an integral rigid or water impervious backing.

The mopping, dusting, or backing layers may include elastic materials, for example to help secure a cleaning sheet to a mop head or other cleaning tool. For example, the mopping or backing sheet may include an elasticized periphery that secures to a cleaning tool, for example a tool presenting a recess into which the elasticized periphery can engage.

A mopping sheet may be pre-moistened. The mopping sheet may also contain cleaning compounds which act in cooperation with premoistening and/or an external source of liquid to assist mopping of the surface. Cleaning compounds include surfactants (such as anionic and cationic surfactants), oxidizing agents (such as hypochlorites (e.g. conventional bleach, sodium hypochlorite), percarbonates, peroxides (such as hydrogen peroxide), persulfates, and the like), other disinfectants (such as ammonium compounds), water softeners, solvents (such as acetone or isopropyl alcohol), and the like. Cleaning compounds can be infused into the mopping sheet, or otherwise supported by the mopping sheet. Conditioning compounds (such as Armor All®) may also be added.

The dusting sheet may be pretreated with a dusting oil, or a compound to enhance electrostatic charge developed when the dusting sheet is moved across the surface. For example, fibers in the dusting sheet may be treated with an electret material to enhance the electrostatic attraction to dust.

If a multi-layer cleaning sheet includes a mopping sheet and a water absorbing layer, either or both may include a cleaning compound. A cleaning compound can also be contained in a separate sealed pouch which is opened just before use of the mopping sheet. For example, removing a dusting sheet from a cleaning sheet may open a pouch which dispenses a cleaning compound onto the mopping sheet.

In some situations, attempting to dry dust a surface may cause dust to be spread over a wider area. This may a particular problem if the dust is hazardous. In this case, it can be advantageous to damp mop first using a mopping sheet, then use a dusting sheet to remove residual dust, for example using electrostatic attraction. The surface may be dried after mopping, or may be allowed to dry naturally.

A further embodiment of the present invention provides a cleaning sheet presenting a mopping sheet for mopping a surface. After mopping, the mopping sheet can be removed, presenting a dusting sheet which can be used to remove any residual dust. In another embodiment, a second mopping sheet can be used for drying a previously mopped surface, for example before a final dusting.

Figure 58:
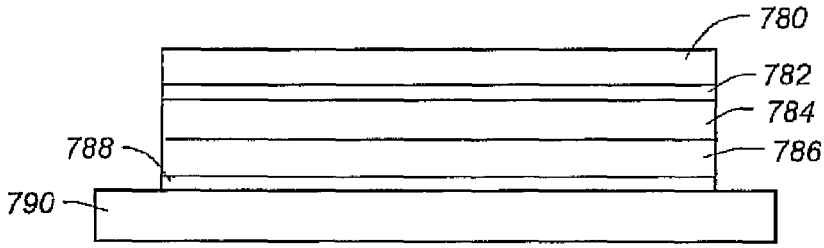
FIG. 58 shows a cleaning sheet having a plurality of alternating mopping and dusting sheets.

FIG. 58 shows a cleaning sheet including a first mopping sheet 780, a first water impermeable sheet 782, a dusting sheet 784, a second mopping sheet 786, a second water impermeable sheet 788, and a second dusting sheet 790. Tabs on the second dusting sheet can be used to secure the cleaning sheet to a cleaning tool. The cleaning sheet, which can be used as a mop refill, allows a surface to be mopped, the mopping sheet, and a water impermeable sheet to be removed so as to allow the surface to be dusted. The mopping sheet may include an integral water impermeable sheet. Cleaning sheets may be provided with a plurality of alternating mopping and dusting sheets.

A multilayer cleaning sheet having a dusting sheet and a mopping sheet can be used for cleaning pets. The pet is wiped with a dry dusting sheet, to remove dirt and loose hairs. The dusting sheet is removed from the cleaning sheet, allowing the pet to be wiped with a mopping sheet.

In other embodiments, a dusting sheet having a long nap can be used, for example to facilitate removal of hairs. A tacky sheet can be used in place of or in addition to the dusting sheet. A tacky sheet presents a weak adhesive layer, for removal of dust and hairs. Embodiments of the present invention can be used to clean pets such as dogs, cats, rabbits, and horses, reptiles, and other animals.

In other embodiments, a tacky sheet can be used in place of or in addition to a non-tacky dusting sheet. For example, a tacky sheet may include a non-woven sheet, woven sheet, plastic film, other sheet, fibrous material, and the like. A tacky sheet may be formed from a naturally tacky material, or may be a sheet infused with or otherwise supporting a tacky material such as an adhesive (for example, a pressure-sensitive adhesive film).

A surface may be cleaned by wiping the surface with a tacky sheet, then removing the tacky sheet from a multi-layer cleaning sheet (for example by pulling on a tab on the tacky sheet) so as to expose a mopping sheet, mopping the surface with the mopping sheet, then disposing of the cleaning sheet (including the mopping sheet). Other embodiments will be clear to those skilled in the relevant art. For example, a tacky sheet may be removed from a cleaning sheet so as to expose a non-tacky dusting sheet, or a non-tacky dusting sheet removed from a cleaning sheet so as to expose a tacky sheet, or a mopping sheet removed from a cleaning sheet so as to expose a tacky sheet.

In various embodiments, the dusting sheet, tacky sheet, or mopping sheet may include a textured surface to collect dirt or dust. For example, a sheet may include folds, pockets, loose flaps, trailing pieces, ridges, grooves, undulations, holes, concertina-shaped portions, non-flat portions such as scrunched portions or wadded portions, protruding fibers and loops, raised edges, and the like. Peripheral portions of sheets can be provided with additional dirt retaining regions, such as tacky or extra-tacky regions, dust retaining raised edges, and the like. The forward or rear edge regions of a sheet may contain different textures, such as bristles, low friction regions, and the like.

Embodiments of the present invention can be used as an improved lens cleaner. For example, a lens can be rubbed with a dusting sheet to electrostatically remove dust. The dusting sheet can be removed, and the lens then rubbed gently with a pre-moistened mopping sheet. For delicate surfaces, such as lenses, it is particularly important to remove potential scratching agents before rubbing the surface.

Embodiments of the present invention may also be used as an improved motor vehicle or glass cleaner. For example, an auto's surface can be buffed with a cleaning sheet and the surface then rubbed with a pre-moistened sheet. Alternatively, a pre-moistened sheet may be provided with a cleaner, which is then removed to expose a moist waxing sheet. Alternatives include the provision of a dusting sheet, a pre-moistened cleaning sheet, and a waxing sheet, the provision of two or more pre-moistened cleaning sheets, the provision of two or more waxing sheets, the elimination of the dusting sheet, and/or the provision of additional cleaning sheets or pre-treated protectant dispensing sheets.

In other embodiments, a drying sheet may also be provided for drying a surface after mopping. For example, a surface can be cleaned with a pre-moistened mopping sheet (or a mopping sheet moistened by liquid applied to the sheet or the surface to be cleaned), and the mopping sheet can then be removed, for example by pulling on a tab, to expose a drying sheet. The drying sheet may include water absorbing materials.

A cleaning sheet may also present a pre-moistened mopping sheet, which is detachable so as to present either a drying sheet, a dusting sheet, or a polishing sheet. A polishing sheet can be similar to dusting sheets described earlier, and may also be pretreated with polishing compounds. For example, an improved shoe wipe includes a premoistened wiping sheet, removable so as to expose a polishing sheet infused or otherwise supporting a shoe polish. Alternatively, a shoe wipe may include a pre-moistened cleaning sheet, a shoe polishing sheet, and a dry buffing or polishing sheet.

In other embodiments, the dusting sheet may be reversible, allowing dusting with one side of the dusting sheet, reconfiguration of the dusting sheet so that a second, clean side is exposed, dusting with the second side of the dusting sheet, removal of the dusting sheet, and mopping with a mopping sheet.

Refills for mops and other cleaning tools can be provided which allow alternate mopping and dusting of a surface. For example, a refill may present a dusting sheet, which is removable to expose a mopping sheet, which is removable to expose a dusting sheet, and so on. Water impermeable sheets may further separate alternate mopping and dusting sheets, for example to stop a dusting sheet being moistened by use of a previous mopping sheet.

The above embodiments have focused primarily on the cleaning of hard surfaces such as floors. However, the present invention has utility in cleaning many types of surfaces, including but not limited to walls, windows, mirrors, tables, ceilings, and furniture and motor vehicles. Therefore, it should be understood that the word "floors", where used, should be broadly construed to include other surfaces to be cleaned.

In view of the teaching presented herein, other modifications and variations of the present inventions will be readily apparent to those of skill in the art. The foregoing drawings, discussion, and description are illustrated of some embodiments of the present invention, but are not meant to be limitations on the practice thereof. It is the following claims, including all equivalents, which define the scope of the invention.

I claim:

1. A cleaning refill for dusting and mopping a surface, the cleaning refill comprising:

a mopping sheet, having a first side and a second side, the mopping sheet comprising a non-woven sheet of water absorbent material; and a dusting sheet, attached to the first side of the mopping sheet;

a water-impermeable backing sheet attached to the second side of the mopping sheet;

wherein the dusting sheet includes a non-woven web of hydrophobic polymer, the dusting sheet being removable from the mopping sheet so as to expose a mopping area on the first side of the mopping sheet;

whereby a person can dust an area using the dusting sheet, remove the dusting sheet from the mopping sheet, then mop the area using the mopping area of the mopping sheet.

2. The cleaning refill of claim 1, wherein the dusting sheet is substantially rectangular, and attached to the first side of the mopping sheet along a pair of opposed edges.

3. The cleaning refill of claim 1, wherein the dusting sheet includes a tab, the tab being graspable by a user to facilitate removal of the dusting sheet from the mopping sheet, so as to expose the mopping area of the mopping sheet.

4. The cleaning refill of claim 1, wherein the dusting sheet becomes electrostatically charged when wiped over a dry surface, so as to attract dust.

5. The cleaning refill of claim 1, further comprising a water absorbing layer.

6. The cleaning refill of claim 5, wherein the water impermeable sheet is attached to the second side of the mopping sheet around the periphery of the water impermeable sheet, the water absorbing layer being disposed between the second side of the mopping sheet and the water impermeable sheet.

7. The cleaning refill of claim 5, wherein the water absorbing layer includes a water absorbing gel.

8. The cleaning refill of claim 5, wherein the water absorbing layer includes a sponge layer.

9. The cleaning refill of claim 1, wherein the hydrophobic material is a polyester.

10. The cleaning refill of claim 9, wherein the polyester is polyethylene terephthalate or a derivative thereof.

11. The cleaning refill of claim 1, wherein the mopping sheet is pre-moistened.

12. The cleaning refill of claim 1, wherein the mopping sheet is pretreated with a cleaning chemical.

13. The cleaning refill of claim 1, wherein the dusting sheet is pretreated with a dusting oil.

14. The cleaning refill of claim 1, wherein the mopping sheet has a plurality of tabs configured to be gripped by gripping means disposed on a mop head.

15. The cleaning refill of claim 1, wherein the cleaning refill is attached to a mitt, the mitt configured to be supported by a hand of a user.

16. The cleaning refill of claim 1, wherein the cleaning refill is attached to a mop head.

17. The cleaning refill of claim 1, wherein the cleaning refill is tearable from a roll including a plurality of cleaning refill.

18. The cleaning refill of claim 1, wherein the second side of the mopping sheet includes hook and look fastener material for attachment to corresponding material on a mop head.

19. A cleaning refill, comprising:

a mopping sheet having a first side and a second side, the mopping sheet being formed from a non-woven web of water absorbing material;

a water-impermeable backing sheet attached to the second side of the mopping sheet; and a dusting sheet, removably attached to the first side of the mopping sheet, wherein the dusting sheet can be detached from the mopping sheet so as to expose a mopping area of the mopping sheet, whereby the cleaning refill can be used to dust a surface using the dusting sheet, the dusting sheet then being removed and the cleaning refill subsequently used to mop the surface using the mopping area of the mopping sheet after the dusting sheet has been detached from the cleaning refill.

20. The cleaning refill of claim 19, wherein the dusting sheet includes a non-woven web of material, the dusting sheet being substantially non-water-absorbent.

21. The cleaning refill of claim 19, wherein the dusting sheet is removable from the mopping sheet by pulling on a tab extending from an edge of the dusting sheet.

22. The cleaning refill of claim 19, wherein the water impermeable backing sheet has a periphery having a generally rectangular shape, the water impermeable backing sheet being attached to the mopping sheet around the periphery of the water impermeable backing sheet so as to form a pocket, wherein a water absorbent layer is disposed within the pocket between the second side of the mopping sheet and the water impermeable backing sheet.

23. The cleaning refill of claim 19, wherein the dusting sheet has a generally rectangular shape, and is attached to the mopping sheet along a pair of opposed edges.

24. The cleaning refill of claim 23, wherein the mopping sheet has tabs extending outwards, the tabs being grippable by a mop head so as to secure the cleaning refill to a mop head.

25. The cleaning refill of claim 19, wherein the dusting sheet is rectangular and the approximate shape and dimensions of a mop head of the type designed to accept a mop refill, the cleaning refill being useful as a mop refill.

26. A refill for a mop of the type having a mop head, the mop head having grips for retaining the refill on the mop head, the refill comprising:

a mopping sheet, having a first side and a second side, the first side of the mopping sheet having a mopping area, the mopping sheet being water absorbent;

a dusting sheet attached to the first side of the mopping sheet, the dusting sheet being detachable from the refill so as to reveal the mopping area of the mopping sheet, the dusting sheet including a non-woven web of hydrophobic polymer; and a backing sheet attached to the second side of the mopping sheet, the backing sheet being water impermeable, wherein the refill is securable to the mop head using the grips so as to expose the dusting sheet, the mop then operable to dust a surface using the dusting sheet, the dusting sheet then being removable from the refill without removing the refill from the mop head, the mop further being operable to mop a surface using the mopping area of the mopping sheet after the dusting sheet has been removed from the refill.

27. The refill of claim 26, wherein the dusting sheet is substantially rectangular, the backing sheet is substantially rectangular and approximately in register with the dusting sheet, and the mopping sheet has a plurality of tabs being configured to be secured by the grips on the mop head.

28. The refill of claim 26, further including a water absorbing layer in contact with a portion of the second side of the mopping sheet, the water absorbing layer being located between the backing sheet and the mopping sheet.

29. The refill of claim 26, wherein the mopping sheet is a non-woven web of water-absorbing material.

30. The refill of claim 26, wherein the dusting sheet is a non-woven web of polyester microfibers, and further includes a scrim layer in the form of a mesh to enhance the mechanical strength of the dusting sheet.

31. A refill for a mop of the type having a mop head, the mop head having securing mechanism for securing the refill to the mop head, the refill comprising:

a dusting sheet, the dusting sheet being exposed when the refill is retained by the mop head; and a mopping sheet, wherein the mopping sheet is disposed behind the dusting sheet when the refill is retained by the mop head, the dusting sheet being detachable from the refill so as to expose a portion of the mopping sheet;

a water absorbent layer, disposed behind the mopping sheet when the refill is secured by the mop head;

a water-impermeable backing layer;

wherein the dusting sheet is operative to remove dust from a surface using an electrostatic interaction; and wherein the mopping sheet is a water absorbent sheet.

* * * * *